US012644368B1

(12) United States Patent
Chappell et al.

(10) Patent No.: US 12,644,368 B1
(45) Date of Patent: Jun. 2, 2026

(54) JACK ASSEMBLY WITH ANTI-RETRACTION ASSEMBLY AND ASSOCIATED METHODS

(71) Applicant: Scout Surface Solutions LLC, Joshua, TX (US)

(72) Inventors: John A. Chappell, Joshua, TX (US); Lawrence Ray McHorse, Joshua, TX (US)

(73) Assignee: Scout Surface Solutions LLC, Joshua, TX (US)

( * ) Notice: Subject to any disclaimer, the term of this patent is extended or adjusted under 35 U.S.C. 154(b) by 0 days.

(21) Appl. No.: 19/260,856

(22) Filed: Jul. 7, 2025

Related U.S. Application Data

(60) Provisional application No. 63/825,886, filed on Jun. 18, 2025.

(51) Int. Cl.
*E21B 19/22* (2006.01)
*E21B 43/26* (2006.01)

(52) U.S. Cl.
CPC ..... *E21B 43/2607* (2020.05); *E21B 19/22* (2013.01)

(58) Field of Classification Search
None
See application file for complete search history.

(56) References Cited

U.S. PATENT DOCUMENTS 3,840,051 A 10/1974 Akashi et al.
4,796,864 A 1/1989 Wilson
5,018,769 A 5/1991 Albrecht
5,273,256 A * 12/1993 Chambers ..... B60S 9/06 254/425
5,379,974 A 1/1995 Slay et al.
5,435,523 A 7/1995 Hying et al.
5,495,872 A 3/1996 Gallagher et al.
6,099,016 A * 8/2000 Peveler ..... B60S 9/08 254/419

(Continued)

FOREIGN PATENT DOCUMENTS

CA 2638434 1/2010
CA 2870564 11/2017

(Continued)

OTHER PUBLICATIONS

International Search Report and Written Opinion for international application No. PCT/US2025/043657, mailed on Oct. 20, 2025.

(Continued)

*Primary Examiner* — Aaron L Lembo
(74) *Attorney, Agent, or Firm* — Womble Bond Dickinson (US) LLP

(57) ABSTRACT

A fluid conduit assembly and associated methods for a fluid supply system for a hydraulic fracturing system includes a manifold assembly coupled to a series of pumping units by hoses along which a hydraulic fluid is conveyed from the pumps of the pumping units to the manifold assembly. The hoses are supported by a plurality of support assemblies. The support assemblies each include a body with a hose cradle pivotally coupled thereto and in which hose is received. The support assemblies are configured to facilitate movement of the hoses in multiple directions for positioning of the hoses.

22 Claims, 12 Drawing Sheets

(56) References Cited

U.S. PATENT DOCUMENTS 6,145,544 A 11/2000 Dutertre et al.
6,213,491 B1 * 4/2001 Southard, Jr. ..... B60D 1/66 280/475
6,607,183 B1 8/2003 White et al.
7,698,958 B2 4/2010 Matter et al.
8,051,545 B2 * 11/2011 Peveler ..... B60S 9/08 29/434
8,695,693 B2 4/2014 Nguyen et al.
8,794,306 B2 8/2014 Cote et al.
8,851,182 B2 10/2014 Nguyen et al.
8,899,315 B2 12/2014 Nguyen et al.
8,910,924 B2 * 12/2014 Alanko ..... B60S 9/08 254/420
8,944,159 B2 2/2015 Guidry et al.
8,960,307 B2 2/2015 Cain et al.
8,978,763 B2 3/2015 Guidry
9,045,960 B2 6/2015 Vanderford et al.
9,068,450 B2 6/2015 Guidry
9,115,562 B2 8/2015 Guidry et al.
9,133,677 B2 9/2015 Cain et al.
9,297,489 B2 3/2016 Sawchuk et al.
9,376,883 B2 6/2016 Nguyen et al.
9,382,774 B2 7/2016 Vogel et al.
9,416,614 B2 8/2016 Cain et al.
9,518,430 B2 12/2016 Guidry
9,605,695 B2 3/2017 Sawchuk et al.
9,677,698 B2 6/2017 Nguyen et al.
9,719,312 B2 8/2017 Vanderford et al.
9,850,743 B2 12/2017 Harkins et al.
9,869,150 B2 1/2018 Cote et al.
9,932,800 B2 4/2018 Guidry
9,976,372 B2 5/2018 Guidry
10,053,946 B2 8/2018 Nguyen et al.
10,094,195 B2 10/2018 Guidry
10,132,146 B2 11/2018 Guidry
10,138,697 B2 11/2018 Guidry
10,151,167 B2 12/2018 Cain et al.
10,156,122 B2 12/2018 Nguyen et al.
10,260,537 B2 4/2019 Sawchuk et al.
10,295,071 B2 5/2019 Ngueyn
10,385,643 B2 8/2019 Guidry
10,385,644 B2 8/2019 Guidry et al.
10,385,645 B2 8/2019 Guidry
10,400,545 B2 9/2019 Shirley et al.
10,422,483 B2 9/2019 Cook
10,428,614 B2 10/2019 Guidry et al.
10,458,216 B2 10/2019 Hefley
10,480,300 B2 11/2019 Guidry
10,487,637 B2 11/2019 Guidry et al.
10,538,987 B2 1/2020 Guidry et al.
10,655,934 B2 5/2020 Flaster et al.
10,711,556 B1 7/2020 Guidry et al.
10,738,556 B2 8/2020 Guidry et al.
10,753,535 B2 8/2020 McKim et al.
10,876,371 B2 12/2020 Guidry
10,876,376 B2 12/2020 Robinson et al.
10,894,532 B2 * 1/2021 McCarthy ..... B60S 9/08
10,961,800 B2 3/2021 Guidry
10,961,801 B2 3/2021 Christopherson et al.
10,961,802 B2 3/2021 Guidry
10,982,522 B1 4/2021 Hill et al.
10,995,561 B1 5/2021 Travix et al.
11,015,413 B2 5/2021 Guidry
11,060,375 B2 7/2021 Shirley et al.
11,066,913 B2 7/2021 Guidry et al.
11,193,360 B1 12/2021 Yeung et al.
11,193,361 B1 12/2021 Yeung et al.
11,306,835 B1 4/2022 Dille et al.
11,319,757 B2 5/2022 Robinson et al.
11,391,109 B2 7/2022 Guidry
11,434,739 B2 9/2022 Guidry
11,513,500 B2 11/2022 Jaaskelainen et al.
11,608,905 B2 3/2023 O'Brien et al.
11,725,460 B2 8/2023 Robinson et al.
11,732,542 B2 8/2023 Hughes
11,753,890 B2 9/2023 Chapman et al.
11,753,911 B1 9/2023 Kabrich et al.
11,828,148 B2 11/2023 Guidry
11,834,941 B2 12/2023 Guidry
11,859,480 B2 1/2024 Kabrich et al.
11,867,043 B1 1/2024 Adams et al.
11,885,207 B2 1/2024 Garro et al.
11,898,411 B2 2/2024 Guidry
11,920,450 B2 3/2024 Yeung et al.
11,970,920 B2 4/2024 Guidry et al.
11,976,534 B2 5/2024 Guidry et al.
12,000,254 B1 6/2024 Colley, III et al.
12,044,092 B2 7/2024 Guidry et al.
12,044,113 B2 7/2024 Cornelssen et al.
12,060,783 B2 8/2024 Krupa et al.
12,091,955 B2 9/2024 Cornelssen et al.
12,098,783 B2 9/2024 Chen et al.
12,111,331 B1 10/2024 Stroebel et al.
12,134,948 B2 11/2024 Guidry et al.
12,146,399 B2 11/2024 Cornelssen et al.
12,228,024 B2 2/2025 Cornelssen et al.
12,492,625 B1 12/2025 Chappell et al.
12,534,993 B2 1/2026 Cornelssen et al.
2004/0154790 A1 8/2004 Cornelssen
2006/0278858 A1 12/2006 Brocchini
2007/0114039 A1 5/2007 Hobdy et al.
2011/0073792 A1 3/2011 Allen
2012/0085532 A1 4/2012 McGuire
2012/0148348 A1 6/2012 Stockstill et al.
2014/0060806 A1 3/2014 Nguyen et al.
2014/0246192 A1 9/2014 Guidry
2015/0136383 A1 5/2015 Guidry et al.
2015/0329184 A1 11/2015 Deletre et al.
2016/0348468 A1 12/2016 Blacklock
2017/0138144 A1 5/2017 Christopherson et al.
2017/0146155 A1 5/2017 Restivo et al.
2017/0198548 A1 7/2017 Dickinson
2017/0283243 A1 10/2017 Liu
2018/0073346 A1 3/2018 Urdaneta
2018/0119853 A1 5/2018 Guidry et al.
2018/0283102 A1 10/2018 Cook
2019/0024829 A1 1/2019 Potier
2020/0088021 A1 3/2020 Guidry
2020/0103078 A1 4/2020 Scott et al.
2020/0109804 A1 4/2020 Nguyen
2020/0362666 A1 11/2020 Tran
2021/0071503 A1 3/2021 Ogg et al.
2021/0108758 A1 4/2021 Loven
2021/0164313 A1 6/2021 Guidry et al.
2021/0317722 A1 10/2021 Affleck et al.
2021/0388931 A1 12/2021 George et al.
2022/0049802 A1 2/2022 Choate et al.
2022/0112796 A1 4/2022 Jaaskelainen et al.
2022/0185640 A1 6/2022 Schiphorst et al.
2022/0186568 A1 6/2022 Westgarth
2022/0222395 A1 7/2022 Song et al.
2023/0041790 A1 2/2023 Elliott et al.
2023/0071388 A1 3/2023 Liu et al.
2023/0100479 A1 3/2023 Roesner et al.
2023/0119473 A1 4/2023 Roesner et al.
2023/0167709 A1 6/2023 Beason et al.
2023/0175341 A1 6/2023 Guidry
2023/0341061 A1 10/2023 Bull
2024/0035364 A1 2/2024 Post et al.
2024/0044548 A1 2/2024 O'Neil et al.
2024/0117725 A1 4/2024 Adams et al.
2024/0209720 A1 6/2024 Cornelssen
2024/0209721 A1 6/2024 Cornelssen
2024/0337178 A1 10/2024 Cornelssen et al.
2024/0344439 A1 10/2024 Cornelssen et al.
2024/0384637 A1 11/2024 Bolen et al.
2024/0417224 A1 12/2024 Strauss et al.
2025/0034976 A1 1/2025 Cornelssen et al.
2025/0146396 A1 5/2025 Cornelssen et al.

FOREIGN PATENT DOCUMENTS

CN 213505737 6/2021
CN 217401115 9/2022

(56) References Cited

FOREIGN PATENT DOCUMENTS

| | | |
|---|---|---|
| CN | 218971169 | 5/2023 |
| CN | 221400454 | 7/2024 |
| DE | 102017130346 | 6/2019 |
| EP | 1010932 | 6/2000 |
| FR | 3016200 | 5/2016 |

OTHER PUBLICATIONS

International Search Report and Written Opinion for international application No. PCT/US2025/052628, mailed Feb. 25, 2026.
USPTO Invitation to Pay Additional Fees for PCT/US2023/084996, Mar. 6, 2024.
USPTO Invitation to Pay Additional Fees for PCT/US2023/084998, Mar. 6, 2024.
International Search Report and Written Opinion for international application No. PCT/US2023/084998, mailed on May 22, 2024.
International Search Report and Written Opinion for international application No. PCT/US2023/084996, mailed on May 22, 2024.
Choke Relief Valves, CorTec, retrieved at https://uscortec.com/products/choke-relief-valves/.

* cited by examiner

JACK ASSEMBLY WITH ANTI-RETRACTION ASSEMBLY AND ASSOCIATED METHODS

CROSS REFERENCE TO RELATED APPLICATIONS

This application claims priority to, and the benefit of U.S. Provisional Application No. 63/825,886, filed Jun. 18, 2025, titled "JACK ASSEMBLY WITH ANTI-RETRACTION ASSEMBLY AND METHODS OF USE," the disclosure of which is incorporated herein by reference in its entirety.

TECHNICAL FIELD

The present disclosure relates generally to hydraulic fracturing systems and methods, and in particular, to support assemblies including jack assemblies associated therewith having an anti-retraction assembly and methods for installation and use thereof for supporting hydraulic fracturing equipment/components in a stable and secure position during hydraulic fracturing operations.

BACKGROUND

Hydraulic fracturing operations are used for extracting fluids such as hydrocarbon gases and oil, among other gases, natural minerals, or other natural resources from subterranean formations. During a hydraulic fracturing operation, a pressurized fracturing fluid is injected into the subterranean formation via one or more wellbores at a higher pressure than a fracture pressure of the subterranean formation. The pressurized fluid creates fractures that increase a permeability of the subterranean formation so that fluids such as oil, gas, and water, among others, may be more easily extracted to the surface via the wellbore(s). The fracturing fluid is pumped under pressure into and out of the wellbore(s) by pumps connected to the wellbore(s) by fluid conveyance devices. Such conveyance devices may include various combinations of pipes, hoses, conduits, manifolds, tanks, and pumps, among others as will be understood by those skilled in the art, and generally are very heavy, creating additional loads applied to other components and to the connections between the hoses and such components. As a result, such hoses often must be separately supported to reduce the effects of the weight thereof and to try to provide a more even, straight flow path for the fluids to minimize restrictions on the fluid flows. Other hydraulic fracturing equipment, such as pumps, junctions, valves and monobore assemblies, likewise are generally supported above the ground to protect them from contaminants and further help avoid potential restrictions of the fluid flows. In addition, the high pressures and flow rates of the pressurized fluid flows passing through the hoses and other hydraulic fracturing equipment, and the resultant turbulence thereof causes the hydraulic fracturing equipment to be subject to extreme vibration, which vibration is further communicated to the support stands therefor. As the jack legs of the support stands are subjected to such vibration, they can rotate or be caused to retract or potentially collapse, which in turn can lead to undue stresses, misalignment and other potentially damage effects on the hydraulic fracturing equipment supported thereby.

Accordingly, it can be seen that a need exists for support systems and assemblies, including jack assemblies for adjusting an elevation of such support assemblies, which can withstand extreme vibration and other forces generated during a hydraulic fracturing operation without retracting while further facilitating operation of the jack assemblies, and methods of use thereof, which are configured to address the foregoing and other related and unrelated problems in the art.

SUMMARY

A summary of various aspects and embodiments of support systems or assemblies, and jack assemblies configured for use as a part of such support assemblies for supporting fracturing equipment such as for use in hydraulic fracturing operations, and methods of use and installation thereof, are disclosed herein. It should be understood that the present summary is presented merely to provide a brief discussion of example aspects and embodiments of the support assemblies and jack assemblies configured for use as a part of such support assemblies for supporting fracturing equipment, and methods of installation and use thereof, and is not intended to limit the scope of the present disclosure. Indeed, the present disclosure may encompass a variety of aspects and embodiments of the support assemblies and jack assemblies configured for use as a part of such support assemblies for supporting fracturing equipment, and methods of use and installation thereof, in accordance with the principles of the present disclosure that may not be set forth below.

According to some aspects, a support assembly and jack assemblies configured for use with such support assemblies for supporting fracturing equipment during hydraulic fracturing operations are provided. In embodiments, the jack assemblies can include an extensible portion and an anti-retraction assembly that can be coupled to a drive mechanism configured for extending and retracting the extensible portion. In embodiments, the anti-retraction assembly will be configured to facilitate the extension and retraction of the extensible portion while resisting unwanted or undesired movement of the jack assembly (e.g., retraction of the extensible portion) upon being subjected to extreme vibration forces generated during operation of fracturing equipment.

According to an aspect, a support assembly is provided. In embodiments, the support assembly can comprise a stand or similar support having a body including a frame, and in some embodiments, may also include a platform positioned within or on the frame. In embodiments, fracturing equipment can include a monobore assembly, valve(s), junction(s), fluid conveyance device (e.g., a hose, conduit, or a connector), or other components, which will be positioned on the support assembly. In addition, a series of jack assemblies can be positioned about the frame and can be configured to facilitate movement and location of the fracturing equipment at a desired elevation above a surface (e.g., above the ground). In embodiments, each of the jack assemblies can include an anti-retraction assembly configured to resist undue or undesired movement of the jack assembly (e.g., retraction, rotation, or other movement) in response to vibration forces generated by operation of the fracturing equipment during a hydraulic fracturing operation. In embodiments, the anti-retraction assembly will be further configured to be easily engaged and disengaged to facilitate adjustment/operation of the jack assembly for adjusting a position/elevation of the fracturing equipment, without having to remove the anti-retraction assembly or reconfigure the jack assembly.

In embodiments, the jack assemblies can each include a leg structure having an extensible portion configured for raising and lowering the frame of the support stand to position the fracturing equipment, and a drive mechanism for extending and retracting the extensible portion. In addition, in embodiments, the anti-retraction assembly will be linked to the drive assembly, and can be moveable between a first, engaged position adapted to substantially prevent operation of the drive mechanism, and a second, non-engaged position adapted to enable operation of the drive mechanism to extend and retract the extensible portion.

In embodiments, the leg structure of each jack assembly can include a first portion that can comprise an outer body or leg including an internal passage, and a second portion received within the internal passage of the first portion. In embodiments, the second portion will comprise the extensible portion and, in embodiments, can comprise a sliding inner leg connected to the drive mechanism at a proximal thereof, and will be moveable along the internal passage of the first portion. In some embodiments, the second portion can include a foot or support plate at a distal end thereof, and which can be configured to engage the ground surface.

In embodiments, the jack assembly can comprise a screw-jack assembly. In such an embodiment, the drive mechanism can comprise a first drive member, such as a drive rod having screw threads at least partially formed therealong, and a second drive member, such as a drive rod coupled to the second, extensible portion of the leg structure and having screw threads therealong and which are configured to engage with the screw threads of the first drive member. As the first drive member is rotated, the second drive member is correspondingly rotated to cause the second, extensible portion of the leg structure to be extended and retracted.

In embodiments, the first drive rod can include a first or distal end that extends through the first portion of the leg structure, and a second or proximal end that extends through the anti-retraction assembly and terminates at a head. In embodiments, the head can be configured to receive a nut or other fastener thereabout. The nut can be configured to be engaged by a tool such as a wrench, which, in embodiments, can include an impact wrench, for driving rotation of the first drive rod to selectively extend and retract the extensible portion for raising and lowering the body of the support assembly to vary the position of the fracturing equipment.

In embodiments, the anti-retraction assembly can include a body configured to fit about the proximal end of the first drive rod, and which can be slidably received along the first portion of the leg structure. In embodiments, a biasing element will be positioned between a surface of the first portion of the leg structure and a section of the body of the anti-retraction assembly, and will be configured to apply a biasing force to the body of the anti-rotation assembly to urge the body to its engaged position to prevent unwanted operation of the drive mechanism.

In embodiments, the biasing element can comprise a spring, such as a compression spring, while in other embodiments, other biasing elements, such as a hydraulic or pneumatic cylinder, or other device configured to exert a biasing force on the body of the anti-retraction assembly, can be used. In addition, in embodiments, the body can include a bearing plate against which the biasing element is engaged, and a rear plate having an opening through which the first or proximal end of the first drive rod can be received. In embodiments, the opening can be configured to receive and capture the head, and/or a fastener applied thereto when the body is in the engaged position, to prevent rotation of the first drive rod, and thus substantially prevent retraction or other movement of the extensible portion of the jack assembly when subjected to extreme vibration forces.

In embodiments, to extend or retract the extensible portion for adjusting the position of the fracturing equipment positioned on the support assembly, upon application of a counter force sufficient to overcome the biasing force provided by the biasing element, the body of the anti-retraction assembly can be urged toward the non-engaged position. As a result, the head/fastener of the first drive rod is released from the opening to enable operation of the drive mechanism to retract and/or extend the extensible portion.

According to an aspect of the disclosure, a jack assembly comprises: a leg structure comprising: a first portion; a second portion moveable along the first portion; a drive mechanism operatively connected to the first portion and the second portion and configured to cause movement of the second portion with respect to the first portion; and an anti-retraction assembly positioned along the first portion of the leg structure, the anti-retraction assembly including: a body to releasably engage the drive mechanism, and a biasing element positioned in engagement with the body and the first portion of the leg structure, the biasing element configured to provide a biasing force, thereby to urge the body toward a first position for securing the drive mechanism to substantially resist movement of the second portion of the leg structure with respect to the first portion and so that the body moves to a second position when the biasing force is overcome so as to release and enable operation of the drive mechanism for movement of the second portion of the leg structure.

In embodiments of the jack assembly, the first portion of the leg structure comprises a tubular body defining an outer leg having a passage, and wherein the second portion of the leg structure can comprise a tubular body defining an inner leg that is slidably received within the passage.

In embodiments of the jack assembly, the drive mechanism comprises a first drive rod extending through the first portion of the leg structure and having a first end and a second end, the second end including a head, and a second drive rod connected to the second portion of the leg structure and configured to translate a rotation of the first drive rod to a linear motion, and wherein as the first drive rod is rotated, the second drive rod causes the second portion of the leg structure to be extended from or retracted within the first portion of the leg structure.

In embodiments of the jack assembly, the body of the anti-retraction assembly comprises a first section including a pair of spaced arms received on opposite sides to the first portion of the leg structure, wherein a second portion extends traverse with respect to the arms and having an opening defined therethrough, and wherein the opening is configured to receive the head of the first drive rod when the body is in the first position and substantially block rotation of the first drive rod.

In embodiments of the jack assembly, the head of the first drive rod has a configuration with at least three sides, and wherein the opening defined through the second portion of the body of the anti-retraction assembly has a configuration that substantially matches the configuration of the head of the first drive rod.

In embodiments of the jack assembly, the biasing element is positioned between the second portion of the body of the anti-retraction assembly and the first portion of the leg structure.

In embodiments of the jack assembly, the second portion of the leg structure includes a foot positioned at a lower end thereof.

In embodiments of the jack assembly, the biasing element comprises one or more of a spring, a pneumatic cylinder, or a hydraulic cylinder.

According to another aspect, a support assembly adapted to support fracturing equipment is provided, the support assembly comprising: a frame on which the fracturing equipment is positioned and having a plurality of sides; and one or more jack assemblies positioned along the sides of the frame, each of the one or more jack assemblies comprising: a leg structure having an extensible portion, a drive mechanism connected to the leg structure to move the extensible portion between a non-engaged position and an extended position, and an anti-retraction assembly comprising: a body having a first section slidably received about the leg structure and a second section to engage the drive mechanism and substantially block operation thereof when the body is in a first position so as to substantially prevent retraction of the extensible portion of the leg structure due to effects of vibration generated by the fracturing equipment, and allow operation of the drive mechanism when the body is in a second position disengaged from the drive mechanism, and a biasing element to engage and urge the body toward the first position.

In embodiments of the support assembly, the fracturing equipment comprises one or more of: a monobore assembly, fluid conduit, pump, valve, or combinations thereof, through which a pressurized fluid flows.

In embodiments of the support assembly, the drive mechanism comprises a first drive rod extending laterally through the leg structure and a second drive rod extending longitudinally along the leg structure and connected to the extensible portion, and wherein as the first drive rod is rotated, the second drive rod is caused to move along a longitudinal axis extending through the leg structure to selectively extend or retract the extensible portion.

In embodiments of the support assembly, the first drive rod includes a first end and a second end, the second end having a head configured to be engaged by a tool for rotation of the first drive rod; and wherein the second section of the body of the anti-retraction assembly includes an opening having a configuration that substantially matches a configuration of the head such that when the body is in the first position, the head or the first drive rod is received and substantially contained within the opening to substantially block rotation of the first drive rod.

In embodiments of the support assembly, the biasing element comprises one or more of a spring, a pneumatic cylinder, or a hydraulic cylinder, and is positioned between the second section of the body of the anti-retraction assembly and a surface of the leg structure.

In embodiments of the support assembly, the leg structure further comprises an outer tubular body portion having a passage along which the extensible portion is moved.

In embodiments of the support assembly, the extensible portion includes a foot adjustably attached to a distal end thereof.

According to still another aspect of the disclosure, a method comprises: installing an anti-retraction assembly of one or more jack assemblies positioned at one or more locations about a support assembly configured to support fracturing equipment, each of the one or more jack assemblies comprises a drive mechanism to extend and retract an extensible portion of each jack assembly, the anti-retraction assembly comprises a body received along a drive rod of the drive mechanism and having an opening to receive a head of the drive rod, and a biasing element positioned between the body and the jack assembly along which the anti-retraction assembly is positioned and to exert a biasing force to move the body toward an engaged position in which the head of the drive rod is received and substantially captured within the opening so as to inhibit rotation of the drive rod; positioning the support assembly at a selected location at a hydraulic fracturing site; and extending or retracting an extensible portion of the one or more jack assemblies to adjust an elevation of the support assembly above a ground surface; wherein when extending or retracting of the extensible portion, the body of the anti-retraction assemblies of each of the one or more jack assemblies can be moved against the biasing force to a non-engaged position to enable rotation of the drive rod, and after the extensible portion has been extended or retracted, the biasing element urges the body toward its engaged position to inhibit rotation of the drive rod so as to prevent further retraction or extension of the extensible portion in response to vibration due to operation of the fracturing equipment.

In embodiments of the method, installing the anti-retraction assembly comprises positioning the body with a first section thereof slidably received along opposite sides of a jack assembly, with the biasing element engaged between a second section of the body and a side surface of the jack assembly, and with the drive rod of the drive mechanism extending through the body and terminating at a proximal end, and securing the head to the proximal end.

In embodiments, the method further comprises positioning the fracturing equipment on a platform positioned on the frame of the support assembly, and wherein the fracturing equipment comprises one or more of: a monobore assembly, a fluid conduit, a pump, a valve, or combinations thereof, through which a pressurized fluid flows.

In embodiments of the method, extending or retracting the extensible portion comprises applying a counter force against the body of the anti-retraction assembly sufficient to overcome the biasing force and move the body to its non-engaged position. In embodiments, the method further includes releasing the counter force applied against the body and allowing the biasing force to return to its reengaged position.

In some embodiments of the method, extending or retracting the extensible portion further comprises engaging the head of the drive rod with a tool, and rotating the drive rod in a first or second direction.

According to other aspects of the disclosure, a method of using an anti-retraction assembly of one or more jack assemblies associated with fracturing equipment is provided, the method comprising: extending or retracting an extensible portion of the one or more jack assemblies to adjust an elevation of a support assembly above a ground surface so that when extending or retracting of the extensible portion, the body of the anti-retraction assembly of each of the one or more jack assemblies is moved against a biasing force to a non-engaged position to enable rotation of the drive rod; and after the extensible portion has been extended or retracted, urging the body toward an engaged position with the biasing element to inhibit rotation of a drive rod of the one or more jack assemblies so as to prevent further retraction or extension of the extensible portion in response to vibration due to operation of the fracturing equipment.

In embodiments, the method further comprises positioning the fracturing equipment on the support assembly, and wherein the fracturing equipment comprises one or more of: a monobore assembly, a fluid conduit, a pump, a valve, or combinations thereof, through which a pressurized fluid flows.

In embodiments of the method, extending or retracting the extensible portion comprises applying a counter force against the body to move the body to its non-engaged position, engaging the head of the drive rod with a tool, and rotating the drive rod in a first or second direction.

Accordingly, various embodiments of hydraulic fracturing systems, including support assemblies for supporting hydraulic fracturing equipment or components, and which include jack assemblies configured for adjusting a position of the fracturing equipment and having an anti-retraction assembly configured for securing the jack assemblies against retraction or other unwanted movement even when subjected to extreme vibration forces, as well as methods of installation and use thereof, which are directed to the above-discussed and other needs, are disclosed herein. The foregoing and other advantages and aspects of the embodiments of the present disclosure will become apparent and more readily appreciated from the following detailed description, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced; and it will be understood that the drawing figures are not necessarily to scale, and that certain features and components shown therein may be shown exaggerated in scale or in somewhat schematic form and some details of various elements may not be shown in interest of clarity and conciseness.

DESCRIPTION

Figure 1A:
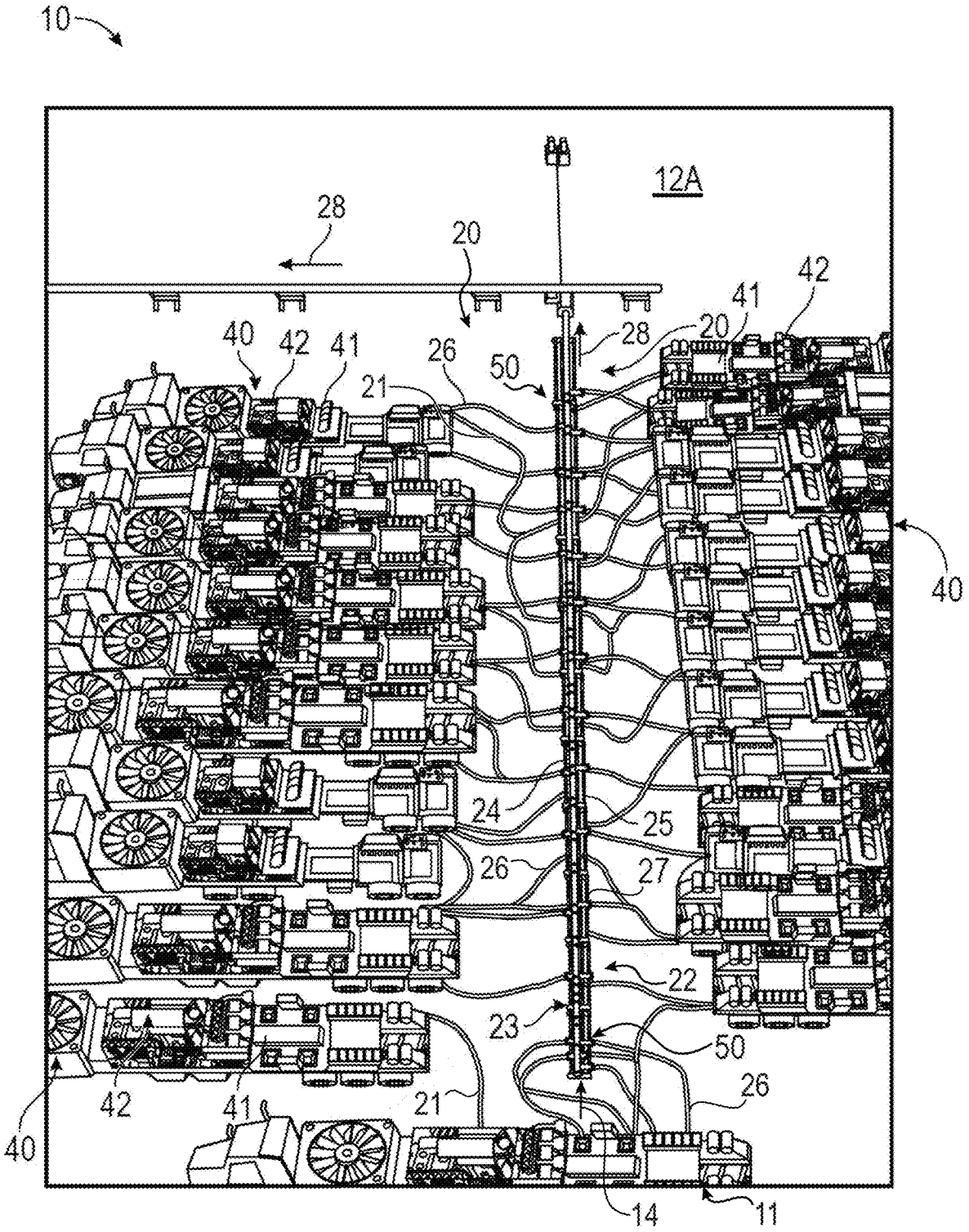
FIG. 1A is a perspective view of an example embodiment of a hydraulic fracturing system including a fluid distribution manifold, pumping units, and hoses connecting the pumping units to the fluid distribution manifold.

Embodiments of the present disclosure will now be described in more detail with reference to the attached Drawing Figures. It will be understood that the following Description in combination with the Figures is provided to assist in understanding the embodiments and principles disclosed herein and should not be interpreted as a limitation on the scope or applicability thereof. Moreover, while the Description and Figures make reference to various exemplary embodiments, it will be understood that the examples disclosed herein have broad application, and that the discussion of any embodiment is meant only to be exemplary of that embodiment, and not intended to suggest that the scope of the disclosure, including the claims, is limited to a specific embodiment or embodiments.

As used herein, the terms "comprises," "comprising," "includes," "including," "has," "having," or any other variation thereof, and are intended to cover a non-exclusive inclusion. For example, a process, method, article, or apparatus that comprises a list of features is not necessarily limited only to those features and may include other features not expressly listed or inherent to such process, method, article, or apparatus. Further, unless expressly stated to the contrary, "or" refers to an inclusive-or and not to an exclusive-or.

Dimensional information in the following description should be understood as nominal dimensions that are intended to encompass variations in dimensions that normally occur in the commercial production of components of hydraulic fracturing systems. Terms such as "approximately," "about," and "substantially" may be used to qualify dimensional information in the following description but such qualifications are intended merely to reinforce that the dimensions are nominal dimensions and not to differentiate qualified dimensions from unqualified dimensions.

The terminology used herein is for the purpose of description only and is not intended to be limiting of the present disclosure. Spatially relative terms, such as "beneath," "below," "lower," "above," "upper," and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if a device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a," "an," and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

In addition, as used herein, the terms "upstream" and "downstream" are used to denote the general flow direction of fracturing fluid through the outlet manifold hydraulic fracturing during operations, according to some embodiments. This convention is used herein for clarity and convenience when describing the outlet manifold and the components and assemblies thereof. An outlet is positioned at the downstream end that is fluidly connected to the wellhead.

Various aspects and embodiments of the present disclosure are generally directed to hydraulic fracturing systems 10 (FIGS. 1A-1B), and in some embodiments disclosed herein, to support assemblies 50 (FIGS. 2A-3B) for supporting fracturing equipment 12 and/or components of hydraulic fracturing systems at a hydraulic fracturing site, and to jack assemblies 65 (FIGS. 4A-8) for use as a part of such support assemblies 11 to provide support and location/positioning of fracturing equipment at varying heights on location (e.g., at a hydraulic fracturing site) where the elevation and positioning of such heavy fracturing equipment is critical, and which include anti-retraction assemblies 90 (FIGS. 5-6) configured to secure the jack assemblies 65 against movement (e.g., retraction, rotation, etc.) due to extreme vibration forces experienced during operation of the supported fracturing equipment during a fracturing operation, and methods of installation and use thereof.

Figure 1B:
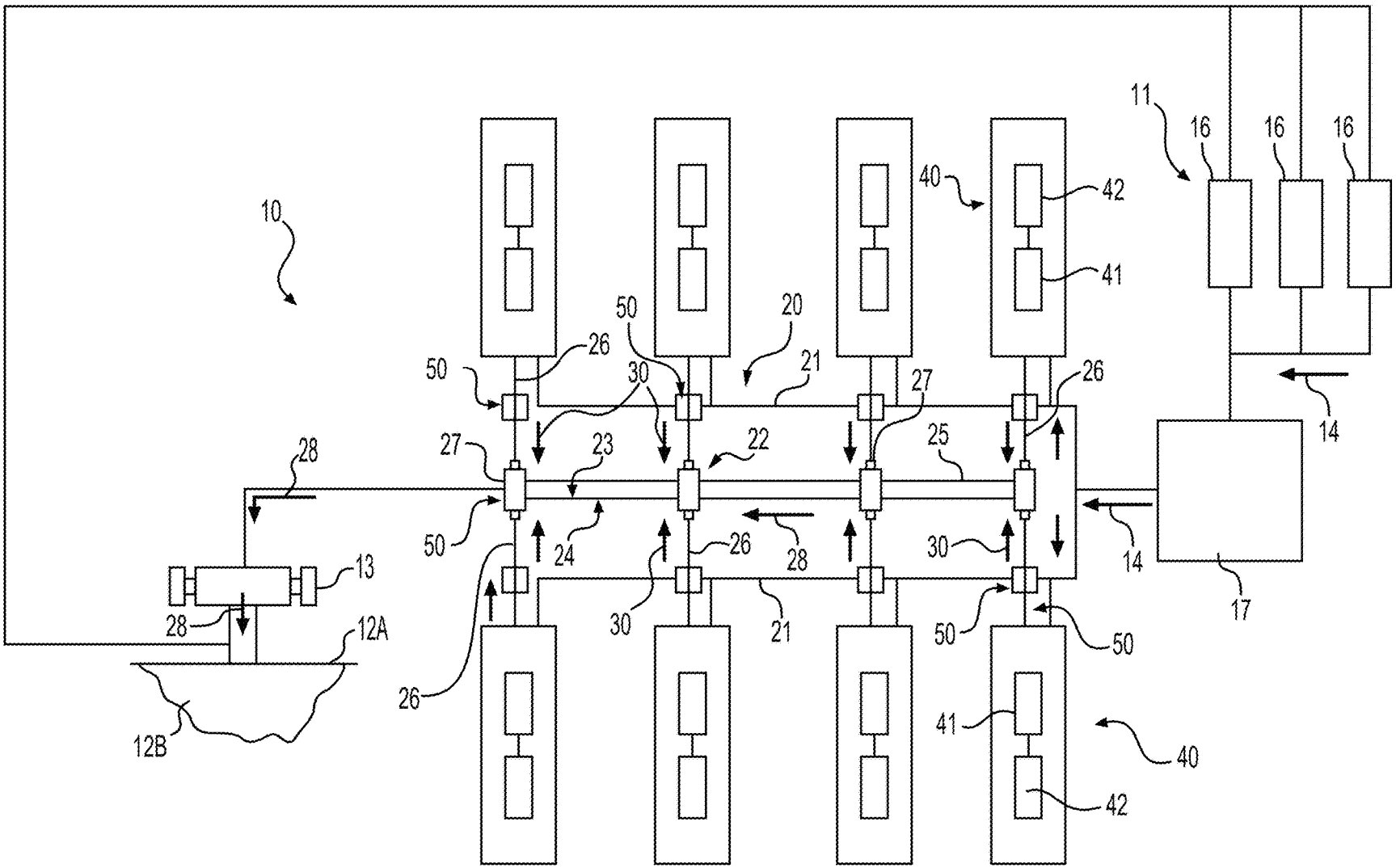
FIG. 1B is a schematic illustration of an example embodiment of a hydraulic fracturing system including a fluid distribution manifold and support assemblies for supporting components such as hoses of the hydraulic fracturing system in accordance with the principles of the present disclosure.
Figure 2A:
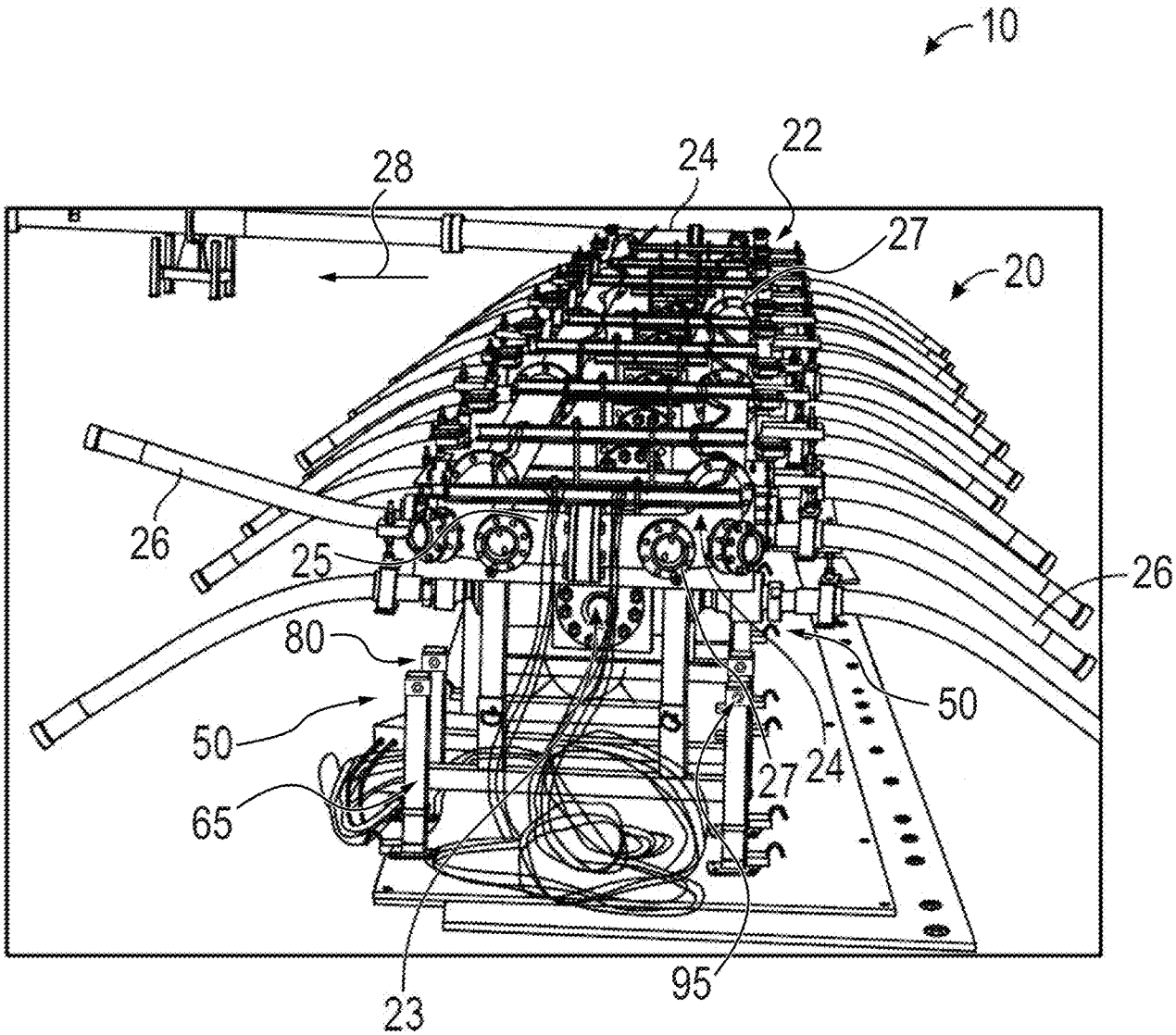
FIG. 2A is a perspective view illustrating an example of a monobore assembly for a hydraulic fracturing system being supported support stands with jack assemblies in accordance with the principles of the present disclosure.

Examples of fracturing equipment 12 (FIGS. 1A-3B) used in hydraulic fracturing systems 10 and operations for delivery of a fluid media under pressure from a fluid supply to one or more wellheads during a hydraulic fracturing application, can include equipment/components such as a manifold assembly 20 and/or components thereof (for example, in embodiments, the manifold assembly can include at least one frac conduit that can comprise a monobore assembly such as indicated at 23 in FIG. 2A), as well as valves, couplings, skids, fluid conveyance devices (e.g., hoses, conduits, tubing, flexible piping, etc.), and other various components of the fracturing systems. By way of example, and only for purposes of illustration, embodiments of the support assemblies and jack assemblies of the present disclosure will be shown and discussed in use for supporting a monobore assembly 23, and/or sections 25 thereof, of the manifold assembly 20, though it will be understood that a variety of other types of fracturing equipment, including other monobore assemblies, also can be used.

Figure 2B:
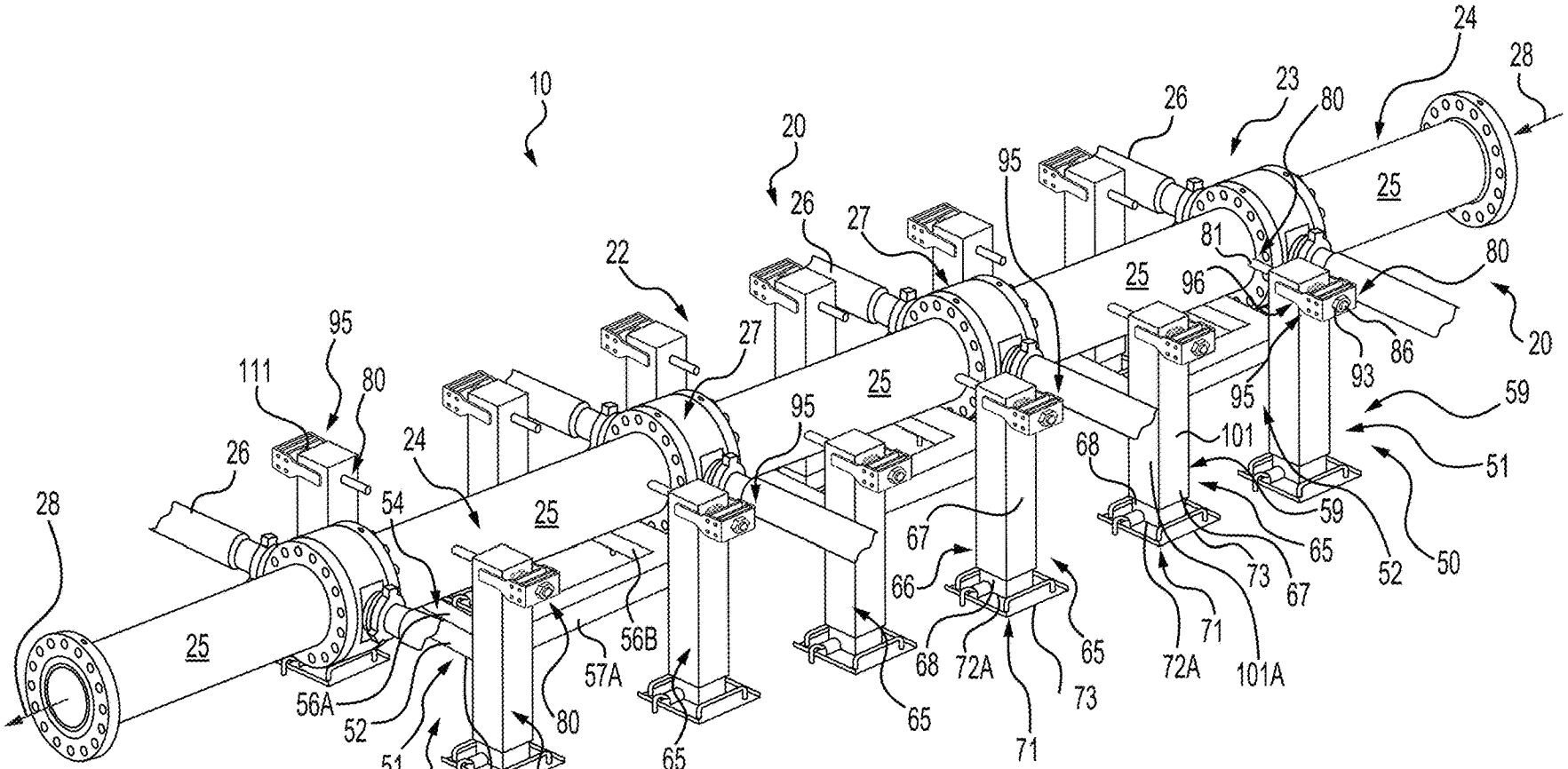
FIG. 2B is a perspective view of a portion of the monobore assembly of FIG. 2A.

It is generally important that monobore assemblies 23 such as shown in FIGS. 2A-2B be supported at elevated positions above a surface such as above the ground at a hydraulic fracturing site, for example, to avoid subjecting the monobore assembly to contact with contaminants, dirt, mud, and debris. Supporting the monobore assembly sections 25 at elevated positions also can help provide for substantially connections to fluid conveyance devices such as conduits or hoses 26 (which can be similarly supported by support assemblies such as disclosed herein) to enable linear flow paths for the fluids to be formed, and to help maximize available working space/area. In addition, the position of the monobore assembly and/or individual sections thereof further may need to be relocated with respect to the surface of the ground such that the support assemblies on which the monobore assembly or portions thereof is supported need to enable adjustment of the monobore assembly and/or individual sections thereof at variable heights or elevations above the surface of the ground.

However, during a hydraulic fracturing operation, substantial vibration forces are generated as large volumes of highly pressurized fracturing fluids are being pumped therethrough, which vibration forces are transmitted to the support assemblies (e.g., stands or other supports) on which a section 25 of the monobore assembly is positioned, and in particular, to the jack assemblies of such supports which can be subjected to extremely high vibration forces that can cause the jack assemblies to rotate and/or retract. As a result, the jack assemblies may no longer provide the necessary support to the section 25 of the monobore assembly, leading to increased stresses, misalignment of the monobore assembly, and other associated effects. Attempts to try to address such effects have included securing trying to the jack legs of existing jack assemblies with wire or other fixed attachments that generally must be removed before adjustment of the jack legs can be made.

As illustrated in the Figures, the support assemblies 50 and jack assemblies 65 are configured to provide support for and facilitate adjustment of the elevation of the monobore assembly 23 (or other fracturing equipment) and/or sections 25 thereof used in hydraulic fracturing operations, thus enabling the monobore assembly to be positioned and/or repositioned at varied elevations/heights above the surface of the ground, and jack assembly further includes an anti-retraction assembly configured to secure the jack assemblies against movement while still facilitating easy and accurate adjustment of the elevation of the fracturing equipment, and other benefits.

It will be understood that the embodiments of the support assemblies and jack assemblies discussed below and as shown in the Figures are example embodiments for purposes of illustration and discussion, and that variations, modifications and changes can be made thereto in accordance with the principles of the present disclosure. In addition, while example configurations of a hydraulic fracturing system 10 and various components thereof are shown in the Figures, it will be understood that the support assemblies, jack assemblies, and methods of use and installation thereof, of the present disclosure can be used with a variety of hydraulic fracturing systems.

FIGS. 1A-1B illustrate an example of a hydraulic fracturing system 10 including a manifold assembly 20. During operations, the hydraulic fracturing system 10 may inject a high-pressure fracturing fluid (e.g., as indicated at arrows 28 in FIG. 1B) from a fluid supply 11 into a wellhead 13 that is connected to a wellbore extending below a ground surface 12A and into a subterranean formation 12B to fracture the subterranean formation 12B. In some embodiments, the hydraulic fracturing system may inject the high-pressure fracturing fluid into a plurality of wellheads so as to access the subterranean formation via a plurality of wellbores. In addition, lower pressure fluids can be extracted and conveyed from a low pressure side of the manifold assembly 20 to the fluid supply.

It should be appreciated that the example hydraulic fracturing system 10 shown in FIGS. 1A-1B depicts only some components and assemblies that may be used during a hydraulic fracturing operation for purposes of illustration, and that in embodiments additional or fewer components may be used within the hydraulic fracturing system 10. Thus, the particular combination and/or arrangement of components of the hydraulic fracturing system 10 depicted in FIGS. 1A-1B are not limiting.

In embodiments, the fluid supply 11 of the hydraulic fracturing system 10 can include a plurality of fluid storage vessels 16 that are each configured to hold a volume of fracturing fluid therein. The fracturing fluid stored in the storage vessels 16 may include any fluid media, including a liquid or semi-liquid (such as a gel) fluid media that is suitable for injection into a subterranean formation for fracturing of the subterranean formation as previously described. In some embodiments, the fracturing fluid can include an aqueous solution including substantially pure water or water mixed with one or more additives (such as gels or gelling agents, chemicals, among others, as will be understood by those skilled in the art). The storage vessels 16 also may include any suitable container for holding a volume of fluids therein. For instance, in some embodiments, storage vessels may include rigid tanks, flexible tanks (such as bladders), open pits, mobile tanks, which may be pulled by a vehicle such as a tractor trailer or other vehicle as indicated in FIG. 1A or a combination thereof.

In some embodiments, a blender 17 (FIG. 1B) can be positioned downstream from the storage vessels 16 and can be configured to mix a proppant into the fracturing fluid. Examples of a proppant may include sand or other suitable solids. The proppant will be configured to flow into the fractures within the subterranean formation 12B as to hold the fractures open after the hydraulic fracturing operation has ended. In some embodiments, additives (such as chemical additives) also may be mixed into the fracturing fluid within the blender either in addition or alternatively to the proppant. In embodiments, the fracturing fluid, with or without a proppant mixed therein, can be supplied, as indicated at arrow 14, to one or more of a plurality of pumping units 40, which pump the fracturing fluid under pressure to a manifold assembly 20 that communicates the fracturing fluid to the wellhead(s) 13.

In embodiments, the manifold assembly 20 can include one or more fluid manifolds, including, as illustrated in FIG. 1B, one or more inlet manifolds 21 that receive the incoming fracturing fluid 14 and direct it to the pumping units 40, and one or more outlet manifolds 22. In embodiments, the one or more outlet manifolds of the manifold assembly 20 can comprise a frac conduit formed as a monobore assembly 23 configured to direct high pressure fluid flows along a flow path 28 to the wellhead(s).

By way of example, in embodiments, the monobore assembly 23 can include a low-pressure fluid section including one or more low-pressure inlets to which low-pressure conduits or lines can be connected, and multiple low-pressure outlets. In addition, in embodiments, such as shown in FIG. 1B, the manifold assembly can include a series of high-pressure fluid conduits 26 that connect to high-pressure inlets or junctions 27 of the monobore assembly 23, and which are configured to direct high-pressure fluid flows (indicated by arrows 30 in (FIG. 1B) from the pumping units 40 for introduction of the high-pressure fluid into the monobore assembly. In embodiments, the high-pressure fluid delivery conduits 26 can comprise hoses coupled to and configured to feed the high pressure fluid into the monobore assembly which directs the high-pressure fluid to one or more high-pressure outlets, which are configured to supply the high-pressure fluid toward the wellhead(s) 13.

In addition, in embodiments such as illustrated in FIG. 2B, the monobore assembly 23 can include an elongated tubular body 24 having a series of sections 25. Junctions 27 can be positioned between the sections, connecting the sections 25 in series. Conduits, such as hoses 26, can be coupled to the junctions 27 and can supply a high pressure fluid to the monobore assembly. As further indicated in FIGS. 1A and 2B, the high pressure fluid will be directed along a path of travel, indicated at 28, and supplied to the high pressure outlet(s) that direct the high pressure fluid to the wellheads for injection into the subterranean formation.

As shown in FIGS. 1A-1B, a plurality of pumping units or systems 40 can be provided as part of the hydraulic fracturing system 10. In embodiments, the pumping units 40 can comprise stationary pumps, or can include mobile pumping units (e.g., transported by a vehicle as show in FIG. 1A). In embodiments, each pumping unit 40 can include a pump 41 driven by a driver 42 (which may be referred to herein as a "prime mover"). Each pump 41 may comprise any suitable fluid pumping device or assembly for pressurizing and pumping the fracturing fluid (with or without proppant and/or other additives entrained therein) to the pressures associated with a hydraulic fracturing operation. For instance, in some embodiments, the pumps 41 may be configured to pressurize the fracturing fluid (with or without proppant and/or other additives entrained therein) to an increased pressure (e.g., a pressure of about 9000 pounds per square inch (psi) or higher). The pumps 41 may include various types of high-pressure pumps, such as a "hydraulic fracturing pump" used for hydraulic fracturing operations. In some embodiments, pumps 41 may include positive displacement pumps, centrifugal pumps, or other suitable types of pumps.

In embodiments, the drivers 42 for the pumps may include any suitable motor or engine that is configured to drive or actuate a corresponding pump 41 during operations. For instance, in some embodiments, the drivers 42 may include a diesel engine, a turbine (such as a gas turbine, steam turbine, among others, as will be understood by those skilled in the art), an electric motor, or some combination thereof. During operations, within each pumping unit 40, each driver 42 may actuate its pump 41 to draw fracturing fluid into the pump 41, pressurize the fracturing fluid, and output the fracturing fluid from the pump 41 to the monobore assembly 23 of the manifold assembly 20 via a fluid conveyance conduit or hose 26 configured to deliver the fracturing fluid to the monobore assembly 23, as well as for return of fluids from the monobore assembly to the fluid supply.

As illustrated in FIGS. 1A and 1B, the pumps 41 of the pumping units 40 generally will be connected to the monobore assembly 23 by hoses 26, which can define fluid flow paths, indicated by arrows 30 in FIG. 1B, along which high-pressure fracturing fluids are transferred from the pumping units to the monobore assembly 23, and along which low-pressure recycled fluid is transferred from the monobore assembly to pumping units 40 and/or the to the fluid supply 11, such as being fed to one or more fluid storage vessels 16. In some instances, the hoses can be connected to valves, such as check valves or choke valves, while in some cases, one or more sections of hoses can be directly coupled together, and in embodiments, the hoses, hose connections, and the valves can be supported on support assemblies 50 so that the hoses and valves can be arranged in a substantially straight alignment between the monobore assembly 23.

FIGS. 2B-3B illustrate embodiments of support assemblies 50 according to principles of the present disclosure. In embodiments, each support assembly 50 can comprise a stand or rack 51 having a body 52 that defines a supporting framework 53 for supporting a section 25 of the monobore assembly 23, or other piece of fracturing equipment, in an elevated position above the surface 12A of the ground. For example, in embodiments such as indicated in FIG. 2B, a plurality of support assemblies 50 can be positioned at spaced locations along the monobore assembly, such as below the junctions, with each of the support assemblies 50 configured to support a section 25 at a same or varying height above the surface of the ground at the fracturing site.

In embodiments, the body 52 of each support assembly 50 can include a frame 53. In embodiments, the frame can be formed as a substantially skeletonized frame to reduce weight and can include a plurality of connected beams or supports 54. For example, as shown in FIGS. 3A-3B, the frame 53 of the body 52 can include metal or metal alloy beams, bars, tubing, or other support members (e.g., steel, aluminum or other metals or metal alloy materials) defining an open sided frame 53.

In addition, in some embodiments, the body can have a modular construction and can comprise one or more sections or modules that can be assembled and connected together to form the support assembly 50, and thereafter can be disassembled for transport and storage; in some embodiments, the body sections can be configured to be stackable for further ease of transport and storage.

Figure 3A:
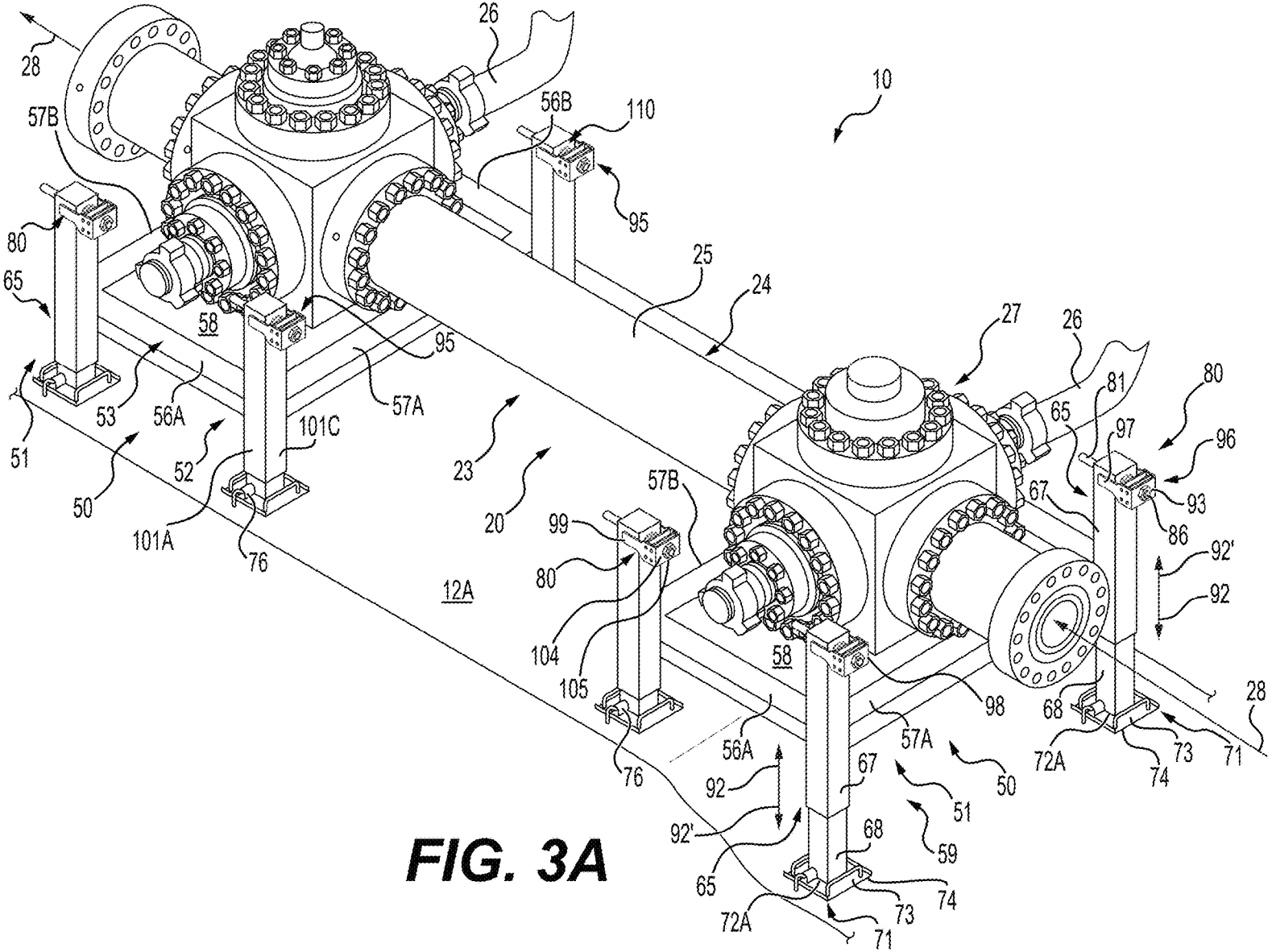
FIG. 3A is a perspective view showing a support assembly supporting a portion of a monobore assembly in accordance with the principles of the present disclosure.
Figure 3B:
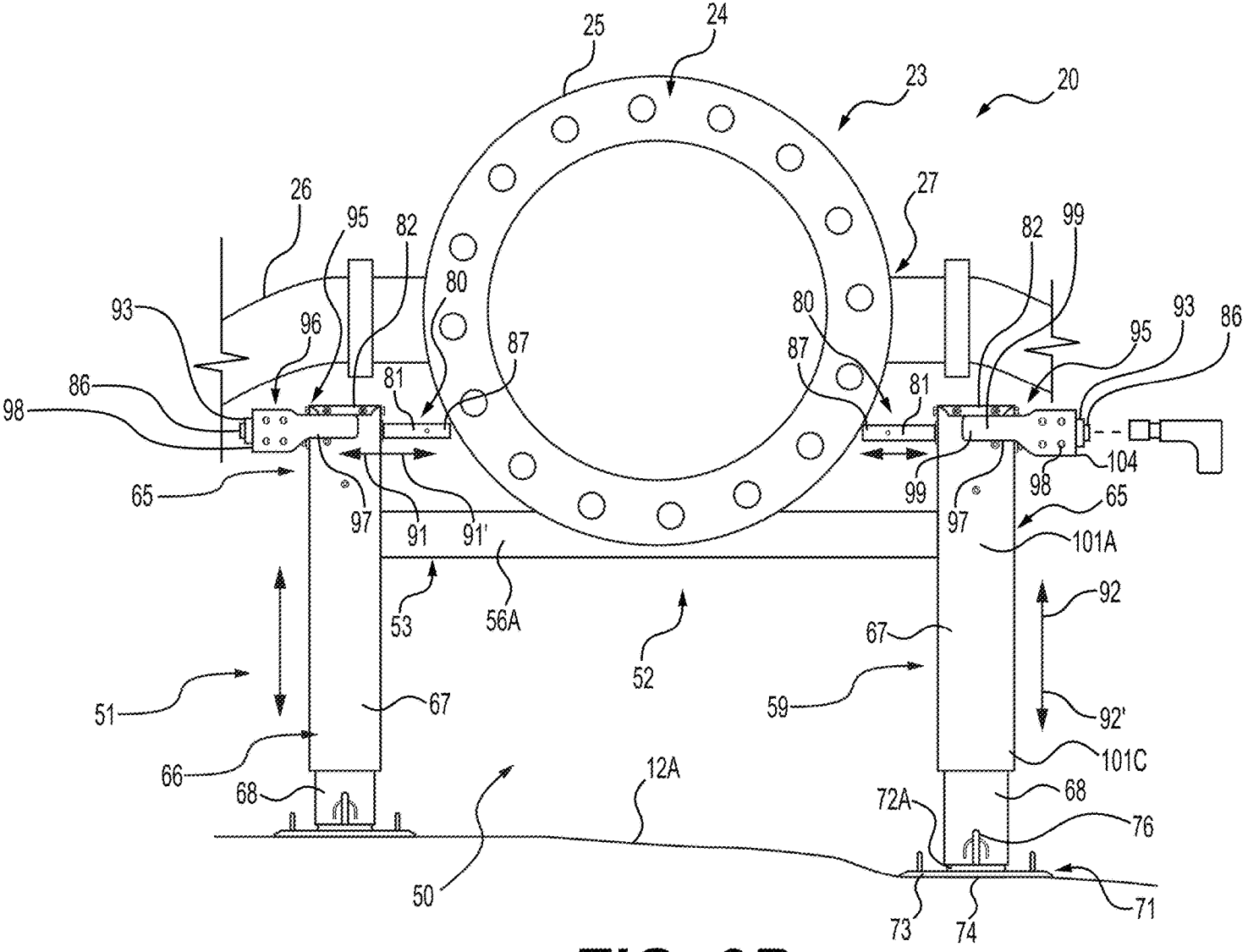
FIG. 3B is an end view illustrating adjustment of a portion of a monobore assembly using a support assembly and jack assemblies in accordance with the principles of the present disclosure.

As further illustrated in FIG. 3A, in one embodiment of the support assembly 50, the body 52 of the support assembly 50 can have a substantially rectangular or square construction including front and rear cross supports 56A/56B and side supports 57A/57B that can define a receptacle or support area in which the section 25 of the monobore assembly is received and supported. In other embodiments, or other configurations (e.g., cylindrical, pyramid-shaped) that provide a stable support for the section, and which, in embodiments, can provide for a substantially balanced distribution of the weight of the section of the monobore assembly supported thereby can be used.

In embodiments, such as illustrated in FIG. 3A, the body 52 of a support assembly 50 further can include a platform 58 positioned between the front and rear cross supports 56A/56B and the side supports 57A/57B and spanning the space therebetween so as to define a supporting surface on which a portion of the monobore assembly 23 can be received. For example, while FIG. 2A generally shows an embodiment in which a tubular section or other portion 25 rests on and is supported by the front and rear cross supports 56A/56B, FIG. 3A shows an example embodiment in which a junction 27 (or other portion) may be supported by the support assembly, such as by being seated on the platform 58. In embodiments the platform 58 can comprise a plate that can be fixed to the rear cross supports 56A/56B and the side supports 57A/57B, such as by welding, or by mechanical connection.

As a further alternative, in some embodiments, the body 52 can be provided with one or more cross braces or center supports that can be extended between the rear cross supports 56A/56B and/or the side supports 57A/57B and can be attached thereto to provide additional support for the section 25 of the monobore assembly 23 positioned thereon. In such an embodiment, the additional center supports can be positioned to help distribute the weight of the component or piece of fracturing equipment supported thereby.

As illustrated in FIGS. 2B-3A, in embodiments, the support assemblies 50 further will include supporting leg structures 59 that, in embodiments, generally will be positioned at the corners of the frame 53 (e.g., at junctions between the cross supports 56A/56B and the side supports 57A/57B). In embodiments, the leg structures 59 can be attached, such as by welding or other means of securing the leg structures to the frame.

As illustrated in FIGS. 2A-3B, in some embodiments, the leg structures 59 generally can be configured as jack assemblies 65 configured to facilitate movement (e.g., raising and lowering) of the support assemblies to vary or adjust the height of the support assemblies as needed to locate the monobore assembly (and the individual sections thereof) at a desired elevated position with respect to a surface of the ground. The jack assemblies 65 generally will be configured to be independently operable to enable individual adjustments of the height of each side of the body, for example, for ensuring the sections of the monobore assembly supported thereby are substantially level with respect to the surface of the ground and substantially in line with one another.

Example embodiments of jack assemblies 65 in accordance with the principles of the present disclosure are illustrated in FIGS. 4A-5B and 8. As illustrated, in embodiments, each of the jack assembly 65 can include a body 66 formed as a telescoping structure. In embodiments, the body will include a first portion 67 formed as an outer tubular body defining an outer leg that generally will be secured to the frame 53 of the support assembly 50 (e.g., by being welded or mechanically connected to the front and rear cross supports and/or side supports), and a second, extensible portion 68 that generally is formed as an inner leg that is received within and is slidable along an interior passage 69 (FIG. 8) defined within the first portion or outer leg 67. The first and second or outer leg 67 and inner leg 68 generally will be formed from a metal or metal alloy and can include, for example, square or cylindrical tubing.

In addition, as further illustrated in FIGS. 3B-5B, a supporting base or foot 71 can be positioned at a distal end 72A of the inner leg 68. In embodiments, the foot 71 can comprise a plate 73 having a lower surface 74 configured to engage the surface of the ground. The foot further generally will be configured such that it extends past the sides of the inner leg to help stabilize the jack assembly in position. In embodiments, the foot can be movably coupled to the distal end of the inner leg 68 of the jack assembly 65 (e.g., being tiltable or pivotable in one or more directions), and can be secured in place with a lock 76 extending through the inner leg 68 and operable to substantially fix the foot in place.

In embodiments, each of the jack assemblies 65 further can include a drive mechanism 80 for driving movement (e.g., extension and retraction) of the inner leg 68 along the outer leg 67 of the jack assembly 50. For example, in some embodiments, the drive mechanism 80 can be mounted at least partially within the outer leg of each jack assembly and received within and extending along the internal passage thereof.

Figure 8:
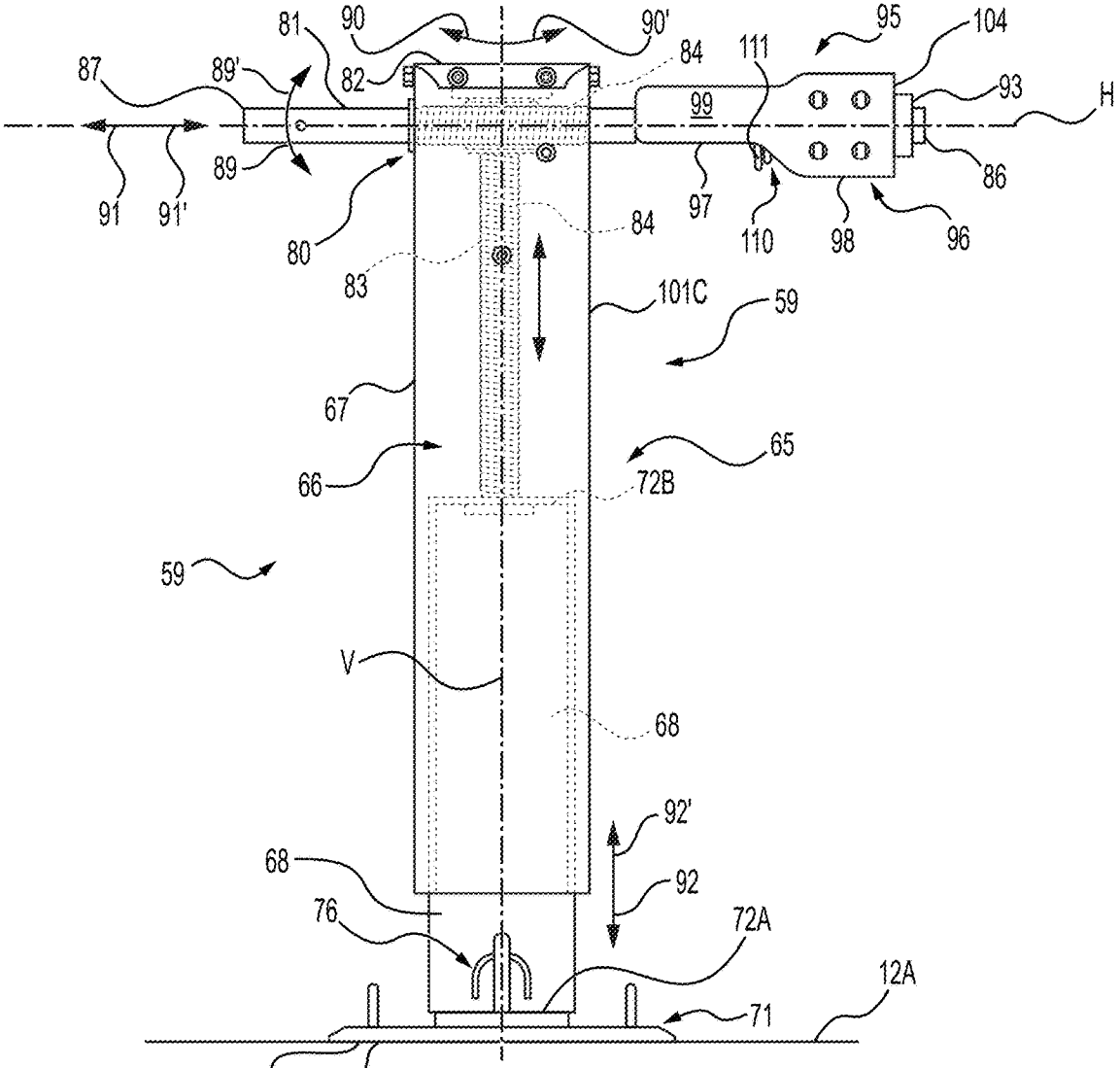
FIG. 8 is a cross-sectional view taken from the front of a jack assembly showing an embodiment of a drive mechanism and anti-retraction assembly, and schematically illustrating the operation of the jack assembly in accordance with the principles of the present disclosure.

In some embodiments, such as illustrated in FIG. 8, the drive mechanism 80 can comprise a screw drive, including a first drive rod 81 extending along a substantially horizontal axis H through an upper or proximal end 82 of the outer leg of the jack assembly, and a second drive rod 83 extending along a substantially vertical axis V through the body of the jack assembly and being connected to a proximal end 72B of the inner leg 68. In embodiments, each of the first and second drive rods 81 and 83 can include a series of helical threads 84 formed along at least a portion of the length thereof. For example, in embodiments, the threads 84 each of the first and second drive rods 81/83 can be formed along an intermediate section between a first or proximal end 86 and a second or distal end 87. In some embodiments, the first and second drive rods can extend through a gear box 88 in which the threads of the first and second drive rods are engaged.

Figure 4B:
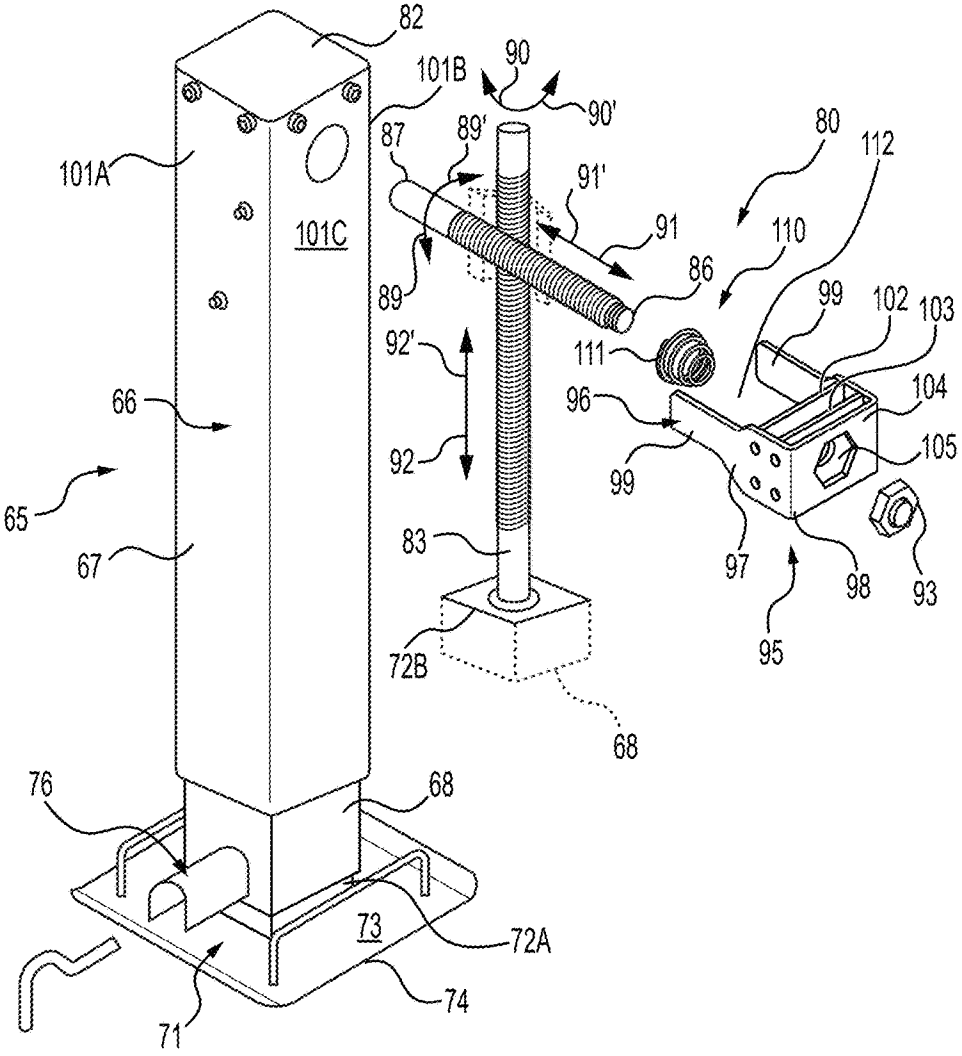
FIG. 4B is an exploded perspective view of the jack assembly of FIG. 3A.
Figure 4A:
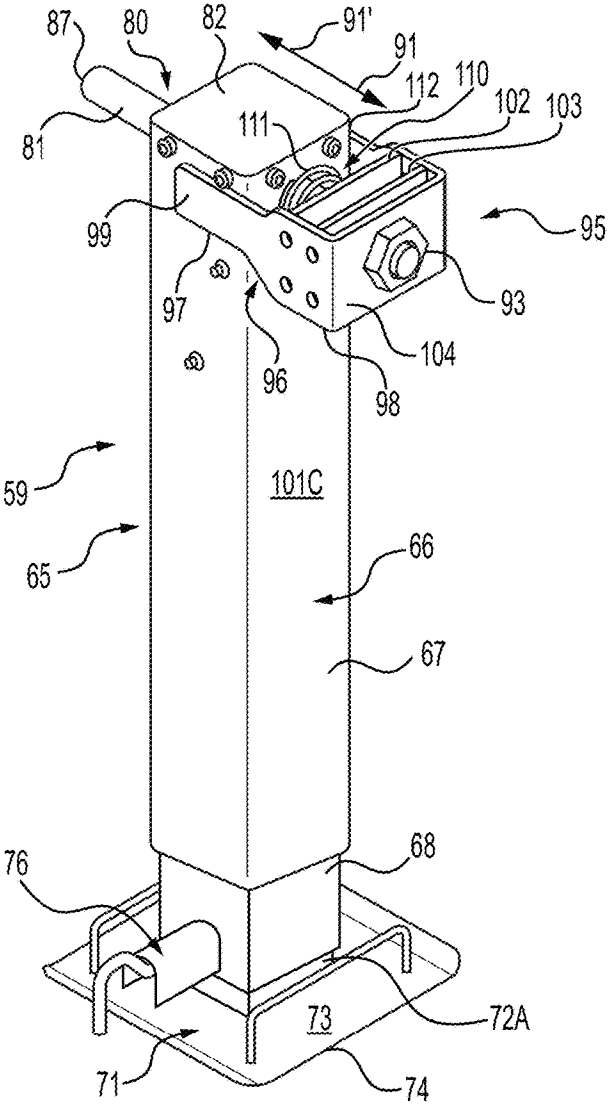
FIG. 4A is a perspective view of an example embodiment of a jack assembly in accordance with the principles of the present disclosure.
Figure 5B:
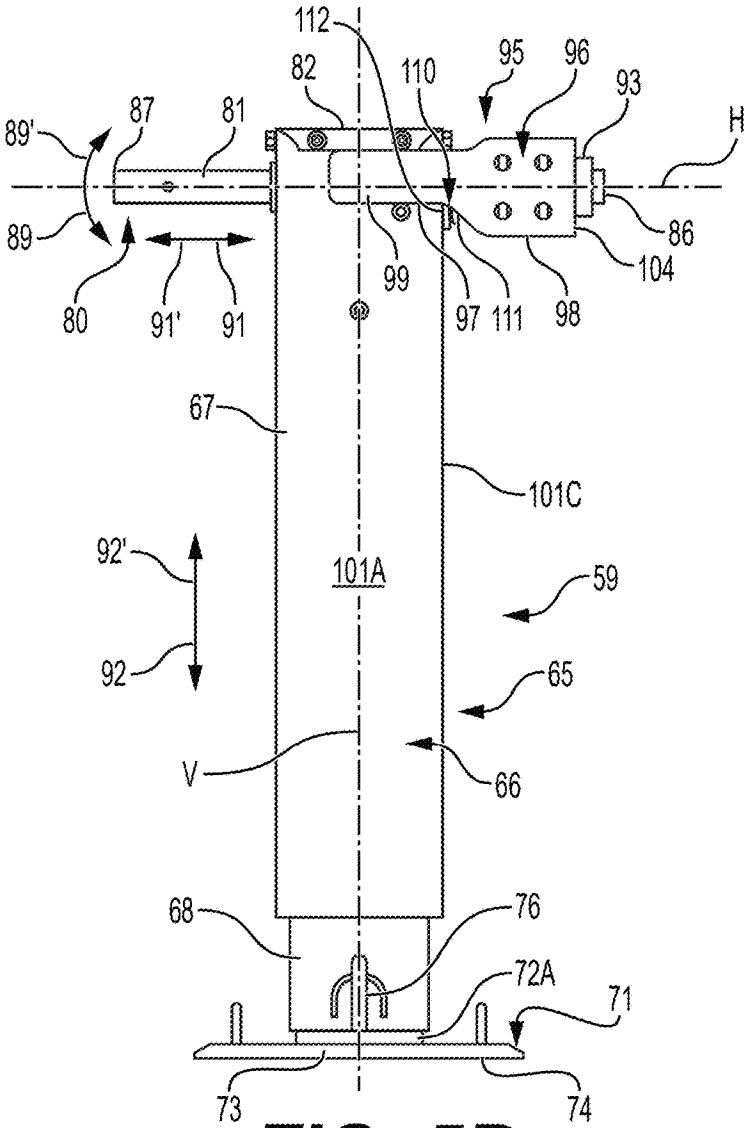
FIG. 5B is a front view of the jack assembly of FIGS. 3A-4A.

In embodiments, the first drive rod is rotated, as indicated at arrows 89/89' in FIGS. 4B and 8, the first drive rod is caused to move horizontally through the proximal end of the outer leg of the jack assembly in the direction of arrows 91/91'. The engagement of the threads of the first and second drive rods in turn causes the horizontal movement of the first drive rod to be translated into a vertical movement by rotation of the second drive rod in the direction of arrows 90/90', which in turn causes the inner leg 68 of the jack assembly to be extended and retracted in the direction of arrows 92/92' to raise and lower the support assembly.

In addition, in some embodiments, the proximal end 86 of the first drive rod and include a head portion, which can include a fastener 93, such as a hex nut or similar fastener can be received about and coupled to the proximal end 86 of the first drive rod. The fastener generally can be configured to fit or engage with a socket such that the first drive rod can be driven/rotated in the direction of arrows 89/89' by a tool to extend and retract the inner leg 68 of the jack assembly as needed to adjust the height of the support assembly, and thus the monobore assembly section supported thereon. For example, in embodiments, the fastener 93 can be received within a socket and driven by wrench, such as an impact wrench or similar power operated tool.

Figure 5A:
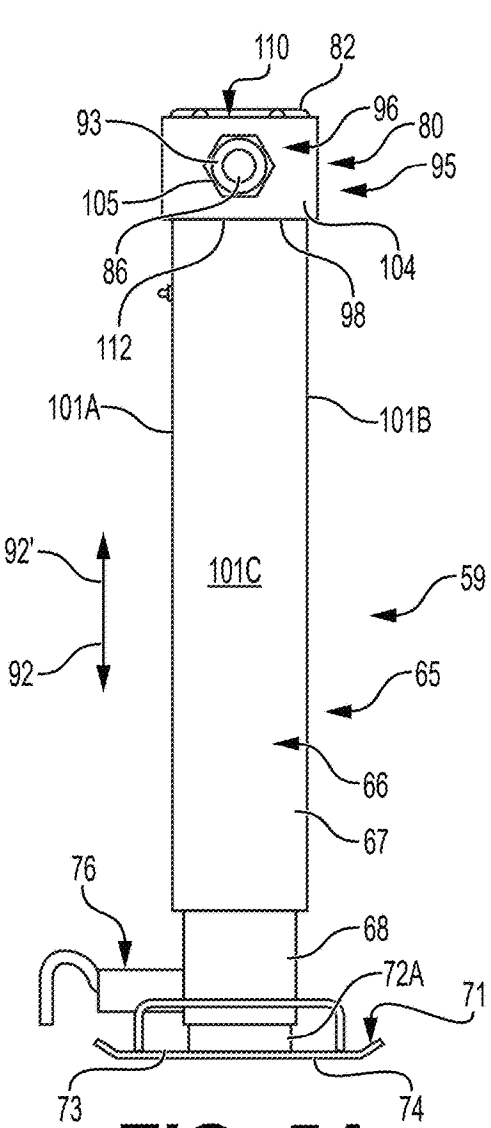
FIG. 5A is a side elevation view of the jack assembly of FIGS. 3A-3B.
Figure 7:
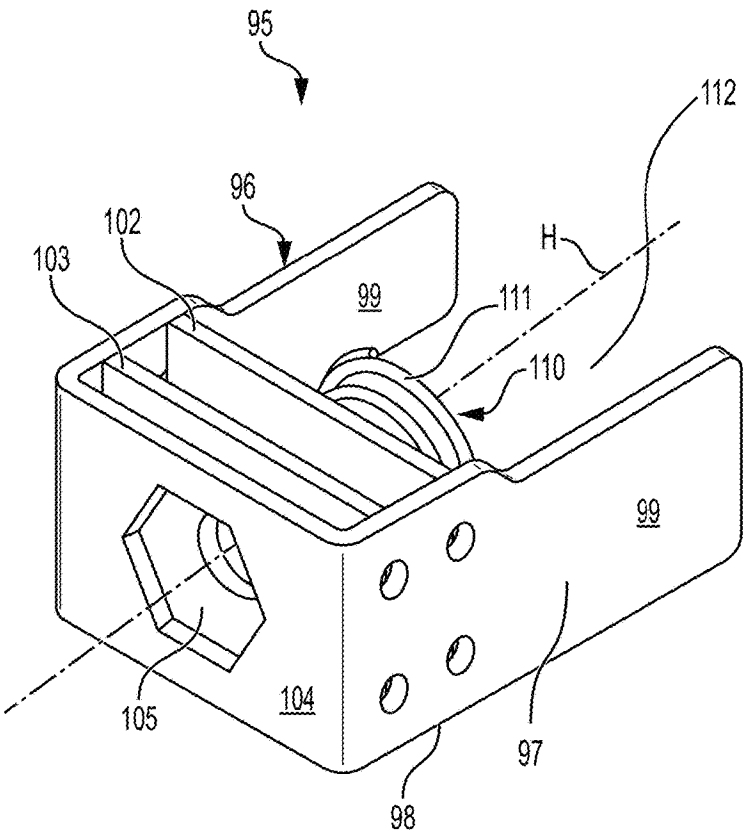
FIG. 7 is a perspective view of an embodiment of an anti-retraction assembly in accordance with the principles of the present disclosure.
Figure 6:
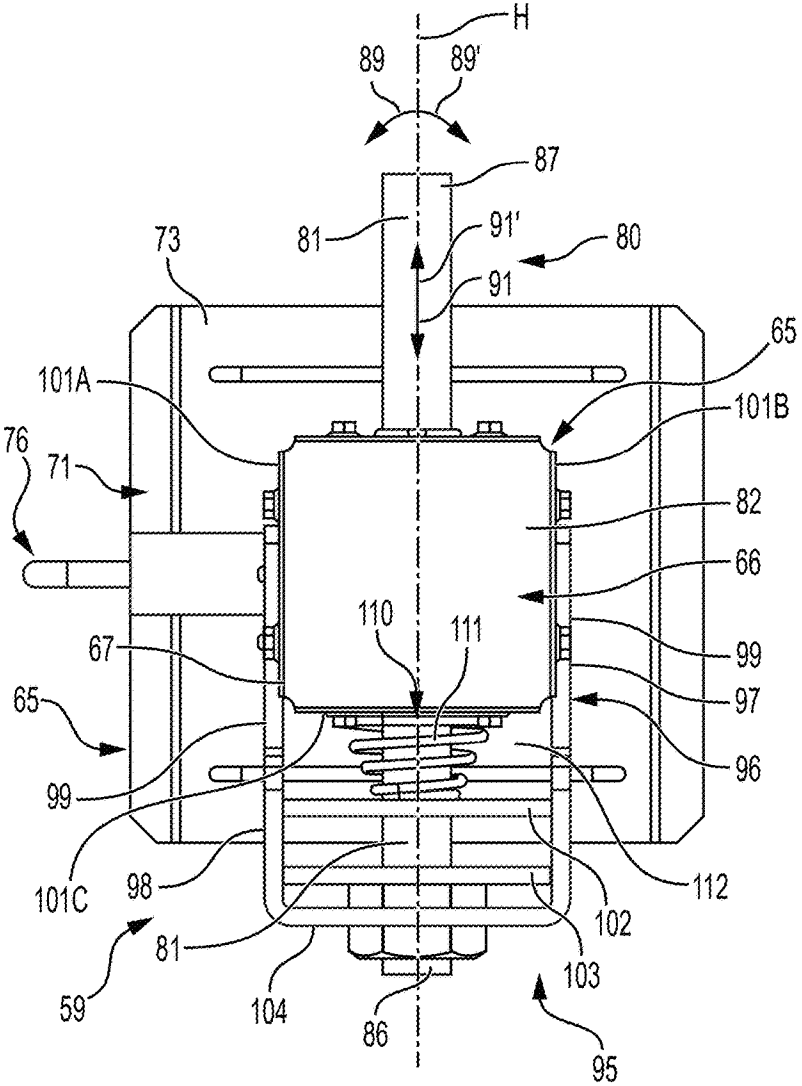
FIG. 6 is a top plan view of an example embodiment of an anti-retraction assembly configured installed a supporting jack assembly in accordance with the principles of the present disclosure.

As further illustrated in FIGS. 4A-8, each jack assembly further will include an anti-retraction assembly 95 positioned adjacent its upper or proximal end and being coupled to the drive mechanism 80. In embodiments, the anti-retraction assembly 95 can include a substantially U or C shaped body or bracket 96 having a front section 97 configured to slide along the sides of the outer leg of the jack assembly and a rear section 98. In one example embodiment, the first section 97 can include a pair of arms 99 spaced apart such that each arm is slidably received along an opposite side surface 101A/101B of the body of the jack assembly 65 as shown in FIGS. 4A-5B. As shown in FIGS. 4B and 6-7, in embodiments, the rear section 98 includes a series of laterally extending plates 102 and 103 and a back portion 104. While a pair of plates 102 and 103 are shown in front of the back portion 104 of the body 96, more or fewer plates also can be used.

As further shown in FIGS. 7 and 8, the back portion 104 includes an opening 105 formed therein. In embodiments, the opening 105 will be configured to receive and capture the head portion at the proximal end of the first drive rod. For example, the opening 105 can have a substantially hex shaped configuration that generally matches the shape of a fastener 93 so that the fastener can be received within the opening and restricted from movement.

In embodiments, a biasing element 110 will be positioned within a recess 112 defined by a space between the arms 99 and the front plate 102. In embodiments, the biasing element 110 can comprise a spring 111 such as a compression spring, which is engaged between the front plate 102 and a side surface 101C of the outer leg of the body of the jack assembly as shown in FIG. 6. The spring will be received about the first drive rod, with its proximal end extending through the spring and through the first and second plates 102 and 103 and the back portion 104 of the body 96, with the head portion thereof projecting through the opening 105. In embodiments, a wave spring or other, similar biasing element, such as, for example, a hydraulic or pneumatic cylinder, also can be provided.

The biasing element 110 will apply a biasing force that urges the body of the anti-retraction device rearwardly toward an engaged position such as shown in FIG. 6. In the engaged position, the head (e.g., the fastener 93) of the first drive rod is captured within the opening 105 of the body of the anti-rotation assembly. As a result, the drive rod is prevented from rotating. Thus, even as the jack assemblies are subjected to extreme vibration forces during a hydraulic fracturing operation, the jack assemblies will remain substantially fixed against movement, with the monobore assembly/section or other fracturing equipment supported thereby being maintained in a stable elevated position.

In embodiments, to adjust the extension and retraction of the jack assemblies, such as for raising and lowering the height of the section of the monobore assembly or other fracturing equipment supported on the support assembly, a user can apply a counter force against the body of the anti-retraction assembly sufficient to overcome the biasing force of the biasing element. As the body 96 is moved to a retracted, non-engaging position, the head (e.g., the fastener 93) of the first drive rod is freed from engagement within the opening 105 enabling rotation of the first drive rod. Thereafter, the first drive rod can be driven/rotated (e.g., using a tool such as an impact wrench) to quickly and easily extend or retract the inner leg of the jack assembly as need to position the section of the monobore assembly or other equipment supported thereby at a desired elevation. In addition, the selective operation of the drive mechanisms of each jack assembly of a support assembly also can help in leveling and stabilizing the section of the monobore assembly and/or the monobore assembly itself, or other equipment supported thereby when positioned on uneven surfaces. When the counter force is released, the body of the anti-retraction assembly will automatically move back to its engaged position to prevent further rotation of the first drive rod.

Figure 9:
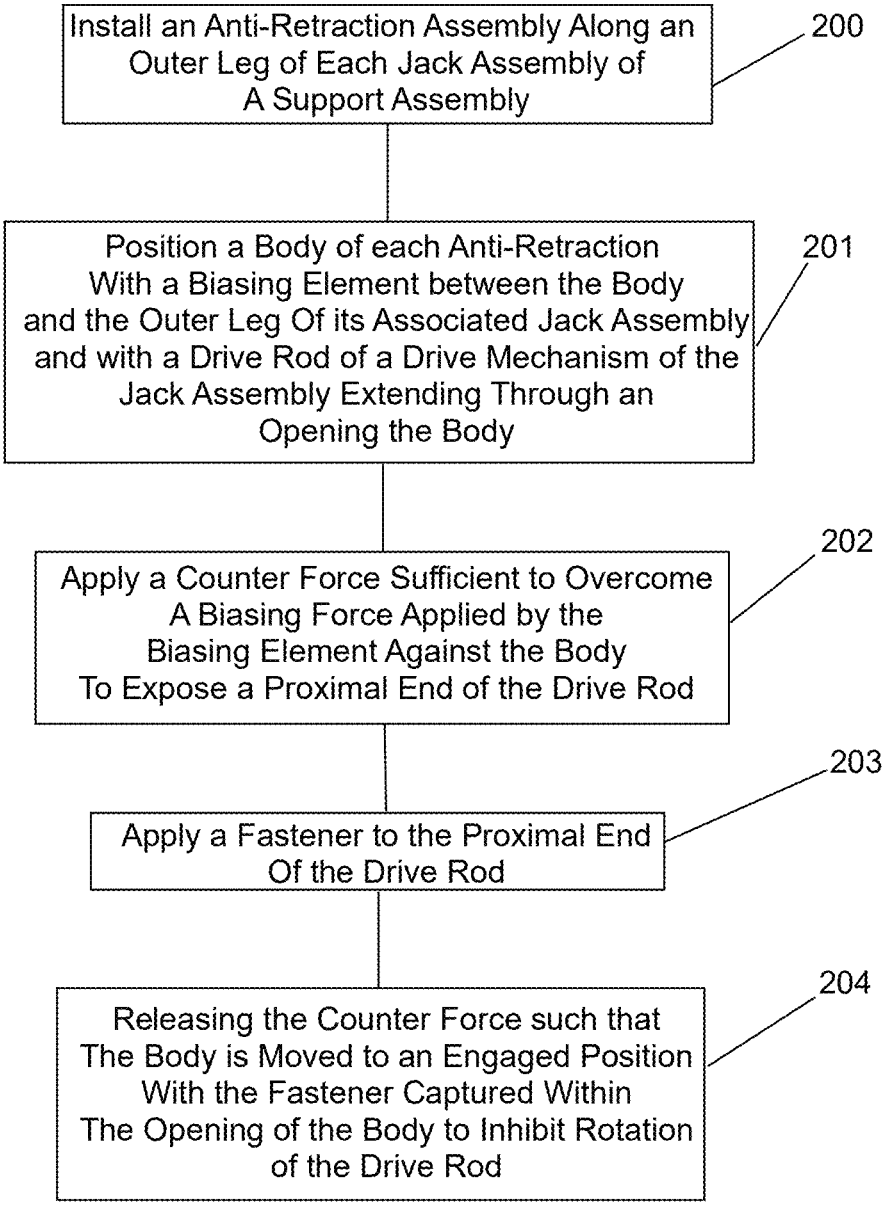
FIG. 9 is a flow diagram illustrating an example embodiment of a method of installing an anti-retraction assembly on a jack assembly of a support assembly such as shown in FIGS. 3A-5B in accordance with the principles of the present disclosure.
Figure 10:
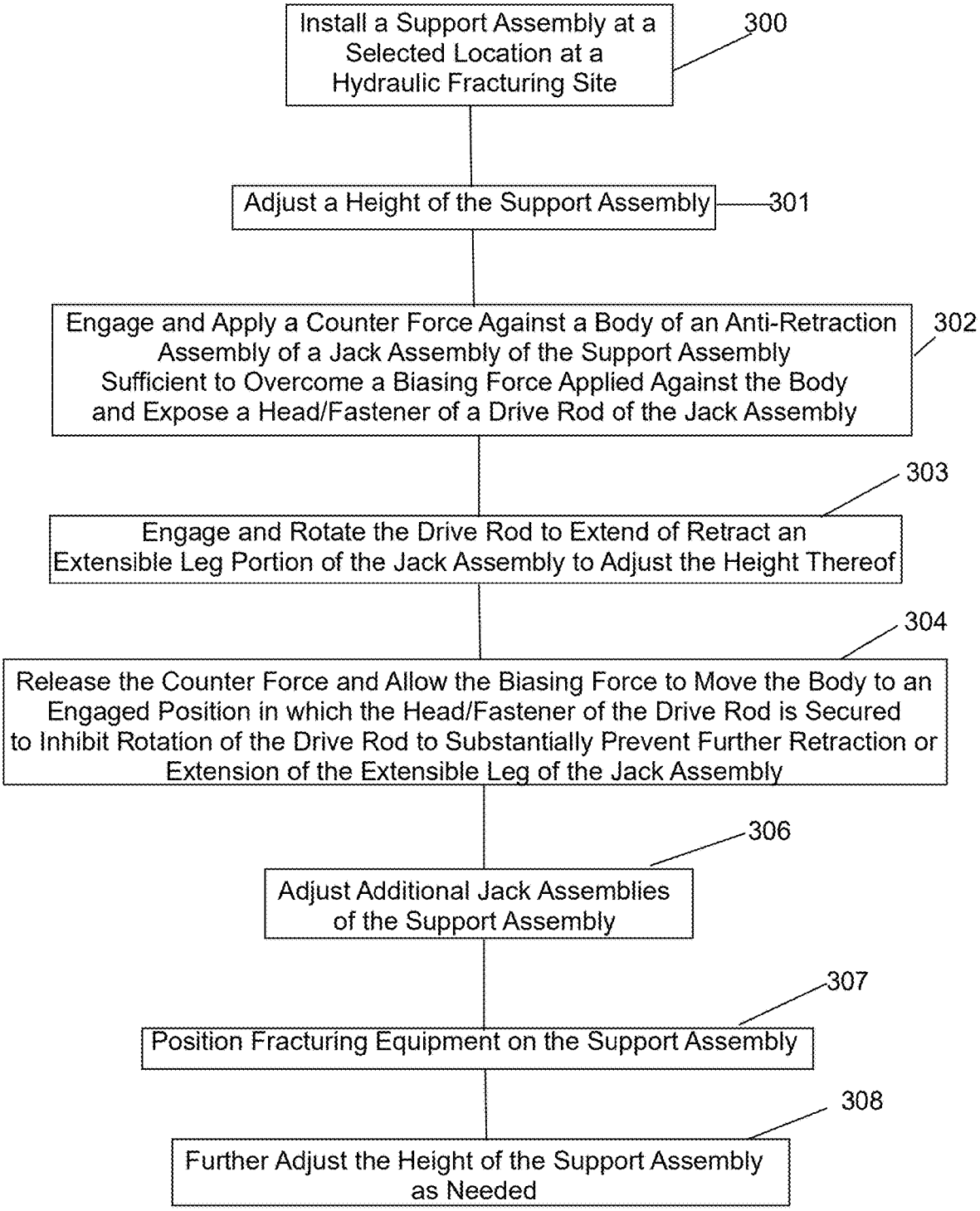
FIG. 10 is a flow diagram illustrating an example embodiment of a method of using a support assembly having a series of jack assemblies including an anti-retraction assembly such as shown in FIGS. 3A-5B in accordance with the principles of the present disclosure.

In embodiments, as indicated in FIGS. 8-10, a method of using the jack assemblies 65 as part of a support assembly 50 can include installing an anti-retraction assembly 95 on each jack assembly positioned at one or more locations about the support assembly on which the fracturing equipment is to be supported. In embodiments, each of the jack assemblies will include a drive mechanism 80 that is operable to selectively extend and retract an extensible portion or inner leg to raise and lower the support assembly as needed. In embodiment, the anti-retraction assembly can comprise a body 96 received along a first drive rod 81 of the drive mechanism 80 and having an opening to receive a head of the first drive rod, and a biasing element positioned between the body of the anti-retraction assembly and a facing surface 101C of the outer leg 67 of the body 66 of the jack assembly along which the anti-retraction assembly is installed.

FIG. 9 illustrates an example embodiment of a method 200 of installing an anti-retraction assembly along an outer leg of a jack assembly of the support assembly. As indicated at 201 in FIG. 9 the anti-retraction assembly can be installed by positioning a body of the anti-retraction assembly along the outer leg of the jack assembly and with a biasing element positioned between the body and a surface of the outer leg, and with a proximal end of the first drive rod extending through an opening defined through the body of the anti-retraction assembly and projecting from a back portion thereof (e.g., as shown in FIG. 5). After the anti-retraction assembly has been installed on the jack assembly, with the proximal end of the first drive rod extending through the body, as indicated at 202 in FIG. 9, a counter force can be applied to the body sufficient to overcome a biasing force applied by the biasing element against the body to expose the distal end of the drive rod. Thereafter, as indicated at 203, a fastener such as a hex nut, or similar cap/securing device, can be affixed to the proximal end of the first drive rod. Once installed, the biasing element of the anti-retraction assembly exerts a biasing force against the body such that as the counter force is released, as indicated at 204, the body can be moved toward an engaged position in which the head/fastener of the first drive rod is received and substantially captured within a corresponding opening formed in the back portion of the body so as to inhibit rotation of the drive rod and thus fix the jack assembly at a selected position or elevation.

Thereafter, the support assembly can be taken to and installed at a selected location at a hydraulic fracturing site. When positioning the support assembly, the jack assemblies thereof can be adjusted to adjust the height of the support assembly with respect to a ground surface, and to adjust the positions of the sides of the support assembly for leveling the support assembly.

FIG. 10 illustrates an example embodiment of a method of using the support assembly, including, as an initial step 300, installing the support assembly at a selected location at a hydraulic fracturing site. At step 301, the height of the support assembly generally will be adjusted, for example, to level the support assembly and/or for setting a height at which hydraulic fracturing equipment is to be supported. To adjust the height of the support assembly, one or more of the jack assemblies of the support assembly can be operated to extend of retract the extensible leg portion thereof.

For extending or retracting the extensible leg portion of the jack assembly for adjusting a height thereof, as indicated at 302, a counter force will be applied to the body of the anti-retraction assembly of the jack assembly sufficient to overcome the biasing force applied to the body and move it to a non-engaged position at which a head/fastener of the first drive rod is exposed to enable rotation of the drive rod. For example, a worker can align a socket or other tool with the head/fastener of the first drive rod and urge the body in a forward direction toward the body of the jack assembly so that the head/fastener is released from the opening and can be rotated to extend or retract the extensible leg portion of the jack assembly as needed to adjust the height thereof, as provided at step 303. After the extensible leg portion has been extended or retracted, as indicated at 304, the counter force applied to the body of the anti-retraction assembly to allow the biasing element move the body toward its engaged position in which the head/fastener of the first drive rod is engaged and substantially captured/secured within the opening of the body to inhibit rotation of the drive rod so as to substantially prevent further retraction or extension of the extensible portion in response to vibration due to operation of the fracturing equipment. Thereafter, as indicated at 306, the height of additional ones of the jack assemblies of the support assembly also can be adjusted as needed.

In addition, as further indicated at 307, in embodiments, the fracturing equipment can be positioned on the support assembly after or prior to adjustment of the jack assemblies. Further, in embodiments, the jack assemblies can be adjusted while the support assembly is in use for supporting the fracturing equipment thereon (step 308).

In some additional embodiments of a method of using the jack assemblies of the present disclosure, the method can include extending or retracting an extensible portion of the one or more jack assemblies to adjust an elevation of a support assembly above a ground surface so that when extending or retracting of the extensible portion, the body of the anti-retraction assembly of each of the one or more jack assemblies is moved against a biasing force sufficient to overcome the biasing force and move the body to a non-engaged position to enable rotation of the drive rod. In embodiments, after the extensible portion has been extended or retracted, the body of the anti-retraction assembly will be urged toward an engaged position by the application of the biasing force by the biasing element. With the body in the engaged position, rotation of a drive rod of the one or more jack assemblies is inhibited so as to prevent further retraction or extension of the extensible portion in response to vibration due to operation of the fracturing equipment.

Thus, the support assemblies and jack assemblies incorporated therewith of the present disclosure are configured to support fracturing equipment used in hydraulic fracturing operations in various positions, including one or more elevated positions above a ground surface and away from contact with potential contact, dirt, debris and corrosive or other contaminant materials on the ground at a hydraulic fracturing site, and to accommodate available space considerations. The support assemblies additionally are configured to facilitate the easy and accurate adjustment of the fracturing equipment between various heights, including for positioning and leveling the fracturing equipment along uneven surfaces, while further providing a mechanism configured to secure the jack assemblies against undesired movement such as retracting or rotation, and which is substantially automatically engaged after an adjustment of the jack assembly is performed.

This application claims priority to, and the benefit of U.S. Provisional Application No. 63/825,886, filed Jun. 18, 2025, titled "JACK ASSEMBLY WITH ANTI-RETRACTION ASSEMBLY AND METHODS OF USE," the disclosure of which is incorporated herein by reference in its entirety.

The present disclosure has been described herein in terms of examples that illustrate principles and aspects of the present disclosure. The skilled artisan will understand, however, that the embodiments described herein are exemplary only and are not limiting, and that a wide gamut of additions, deletions, alterations, and modifications, both subtle and gross, may be made to the presented examples without departing from the spirit and scope of the present disclosure. All such modifications which do not depart from the spirit of the disclosure are intended to be included within the scope of any of the aspects and/or claims provided by the present disclosure.

The invention claimed is:

1. A jack assembly comprising:

a leg structure comprising:

a first portion;

a second portion moveable along the first portion;

a drive mechanism operatively connected to the first portion and the second portion and configured to cause movement of the second portion with respect to the first portion; and an anti-retraction assembly positioned along the first portion of the leg structure, the anti-retraction assembly including:

a body to releasably engage the drive mechanism, and a biasing element positioned in engagement with the body and the first portion of the leg structure, the biasing element configured to provide a biasing force, thereby to urge the body toward a first position for securing the drive mechanism to substantially resist movement of the second portion of the leg structure with respect to the first portion and so that the body moves to a second position when the biasing force is overcome so as to release and enable operation of the drive mechanism for movement of the second portion of the leg structure.

2. The jack assembly of a claim 1, wherein the first portion of the leg structure comprises a tube having a passage, and wherein the second portion of the leg structure is slidably received within the passage.

3. The jack assembly of claim 1, wherein the drive mechanism comprises a first drive rod extending through the first portion of the leg structure and having a first end and a second end, the second end including a head, and a second drive rod connected to the second portion of the leg structure and configured to translate a rotation of the first drive rod to a linear motion, and wherein as the first drive rod is rotated, the second drive rod causes the second portion of the leg structure to be extended from or retracted within the first portion of the leg structure.

4. The jack assembly of claim 3, wherein the body of the anti-retraction assembly comprises a first section including a pair of spaced arms received on opposite sides to the first portion of the leg structure, wherein the second portion of the leg structure extends traverse with respect to the arms and has an opening defined therethrough, and wherein the opening is configured to receive the head of the first drive rod when the body is in the first position and substantially block rotation of the first drive rod.

5. The jack assembly of claim 4, wherein the head of the first drive rod has a configuration with at least three sides, and wherein the opening defined through the second portion of the body of the anti-retraction assembly has a configuration that substantially matches the configuration of the head of the first drive rod.

6. The jack assembly of claim 3, wherein the biasing element is positioned between the body of the anti-retraction assembly and the first portion of the leg structure.

7. The jack assembly of claim 1, wherein the second portion of the leg structure includes a foot positioned at a lower end thereof.

8. The jack assembly of claim 1, wherein the biasing element comprises one or more of a spring, a pneumatic cylinder, or a hydraulic cylinder.

9. A support assembly to support fracturing equipment, the support assembly comprising:

a stand configured to receive and support the fracturing equipment and having a plurality of sides; and one or more jack assemblies, each of the one or more jack assemblies comprising:

a leg structure having an extensible portion, a drive mechanism connected to the leg structure to move the extensible portion between a non-engaged position and an extended position, and an anti-retraction assembly comprising:

a body having a first section slidably received about the leg structure and a second section to engage the drive mechanism and substantially block operation thereof when the body is in a first position so as to substantially prevent retraction of the extensible portion of the leg structure due to effects of vibration generated by the fracturing equipment, and allow operation of the drive mechanism when the body is in a second position disengaged from the drive mechanism, and a biasing element to engage and urge the body toward the first position.

10. The support assembly of claim 9, wherein the fracturing equipment comprises one or more of: a monobore assembly, fluid conduit, pump, valve, or combinations thereof, through which a pressurized fluid flows.

11. The support assembly of claim 10, wherein the drive mechanism comprises a first drive rod extending laterally through the leg structure and a second drive rod extending longitudinally along the leg structure and connected to the extensible portion, and wherein as the first drive rod is rotated, the second drive rod is caused to move along a longitudinal axis extending through the leg structure to selectively extend or retract the extensible portion.

12. The support assembly of claim 11, wherein the first drive rod includes a first end and a second end, the second end having a head configured to be engaged by a tool for rotation of the first drive rod, and wherein the second section of the body of the anti-retraction assembly includes an opening having a configuration that substantially matches a configuration of the head such that when the body is in the first position, the head or the first drive rod is received and substantially contained within the opening to substantially block rotation of the first drive rod.

13. The support assembly of claim 10, wherein the biasing element comprises one or more of a spring, a pneumatic cylinder, or a hydraulic cylinder, and wherein the biasing element is positioned between the second section of the body of the anti-retraction assembly and a surface of the leg structure.

14. The support assembly of claim 10, wherein the leg structure further comprises an outer tubular body portion having a passage along which the extensible portion is moved.

15. The support assembly of claim 10, wherein the extensible portion includes a foot adjustably attached to a distal end thereof.

16. A method comprising:

installing an anti-retraction assembly of one or more jack assemblies positioned at one or more locations about a support assembly configured to support fracturing equipment, each of the one or more jack assemblies comprises a drive mechanism to extend and retract an extensible portion of each jack assembly, the anti-retraction assembly comprises a body received along a drive rod of the drive mechanism and having an opening to receive a head of the drive rod, and a biasing element positioned between the body and the jack assembly along which the anti-retraction assembly is positioned and to exert a biasing force to move the body toward an engaged position in which the head of the drive rod is received and substantially captured within the opening so as to inhibit rotation of the drive rod;

positioning the support assembly at a selected location at a hydraulic fracturing site; and extending or retracting an extensible portion of the one or more jack assemblies to adjust an elevation of the support assembly above a ground surface, when extending or retracting of the extensible portion, the body of the anti-retraction assemblies of each of the one or more jack assemblies is moved against the biasing force to a non-engaged position to enable rotation of the drive rod, and after the extensible portion has been extended or retracted, the biasing element urges the body toward its engaged position to inhibit rotation of the drive rod so as to prevent further retraction or extension of the extensible portion in response to vibration due to operation of the fracturing equipment.

17. The method of claim 16, wherein installing the anti-retraction assembly comprises positioning the body with a first section thereof slidably received along opposite sides of a jack assembly, with the biasing element engaged between a second section of the body and a side surface of the jack assembly, and with the drive rod of the drive mechanism extending through the body and terminating at a proximal end, and securing the head to the proximal end.

18. The method of claim 17, further comprising positioning the fracturing equipment on a portion of a frame of the support assembly, and wherein the fracturing equipment comprises one or more of: a monobore assembly, a fluid conduit, a pump, a valve, or combinations thereof, through which a pressurized fluid flows.

19. The method of claim 17, wherein extending or retracting the extensible portion comprises applying a counter force against the body to move the body to its non-engaged position, engaging the head of the drive rod with a tool, and rotating the drive rod in a first or second direction.

20. A method of using an anti-retraction assembly of one or more jack assemblies associated with fracturing equipment, the method comprising:

extending or retracting an extensible portion of the one or more jack assemblies to adjust an elevation of a support assembly above a ground surface so that when extending or retracting of the extensible portion, a body of the anti-retraction assembly of each of the one or more jack assemblies moves against a biasing force to a non-engaged position to enable rotation of a drive rod; and after the extensible portion has been extended or retracted, urging the body toward an engaged position with the biasing element to inhibit rotation of the drive rod of the one or more jack assemblies so as to prevent further retraction or extension of the extensible portion in response to vibration due to operation of the fracturing equipment.

21. The method of claim 20, further comprising positioning the fracturing equipment on a platform of the support assembly, and wherein the fracturing equipment comprises one or more of: a monobore assembly, a fluid conduit, a pump, a valve, or combinations thereof, through which a pressurized fluid flows.

22. The method of claim 20, wherein the extending or retracting the extensible portion comprises applying a counter force against the body to move the body to its non-engaged position, engaging the head of the drive rod with a tool, and rotating the drive rod in a first or second direction.

* * * * *